US006192857B1

(12) United States Patent
Shimada

(10) Patent No.: US 6,192,857 B1
(45) Date of Patent: Feb. 27, 2001

(54) CONTROL APPARATUS OF ENGINE WITH ELECTRONICALLY DRIVEN INTAKE AND EXHAUST VALVES

(75) Inventor: Kousaku Shimada, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/335,766

(22) Filed: Jun. 18, 1999

(30) Foreign Application Priority Data

Jun. 19, 1998 (JP) ..... 10-172779

(51) Int. Cl.[7] ..... F01L 9/04; F02D 17/02; F02D 13/04

(52) U.S. Cl. ..... 123/322; 123/90.11; 123/295; 123/339.17; 123/339.18; 123/481; 180/197; 477/109

(58) Field of Search ..... 123/90.11, 295, 123/321, 322, 327, 328, 339.16, 339.17, 339.18, 481, 493, 486; 180/197; 477/107, 109

(56) References Cited

U.S. PATENT DOCUMENTS 5,115,782 * 5/1992 Klinke et al. ..... 123/90.11 X
5,117,790 * 6/1992 Clarke et al. ..... 123/90.11 X
5,647,318 * 7/1997 Feucht et al. ..... 123/322
5,765,528 * 6/1998 Kamimaru ..... 123/90.11 X
5,904,128 * 5/1999 Shimada et al. ..... 123/295 X
5,947,863 * 9/1999 Grob et al. ..... 477/109
5,964,200 * 10/1999 Shimada et al. ..... 123/306 X
6,105,555 * 8/2000 Weber et al. ..... 123/493

FOREIGN PATENT DOCUMENTS 63-147957 6/1988 (JP) .
9-88645 3/1997 (JP) .

* cited by examiner

*Primary Examiner*—Tony M. Argenbright
(74) *Attorney, Agent, or Firm*—Evenson, McKeown, Edwards & Lenahan, P.L.L.C.

(57) ABSTRACT

There is provided an engine control apparatus with electromagnetically driven intake and exhaust valves which can widen the dynamic range of engine brake torque. The valve open timing of the electromagnetic exhaust valve during fuel cut is made to be variable between the initial stage of expansion stroke and the late stage thereof so as to control the magnitude of engine brake torque.

21 Claims, 26 Drawing Sheets

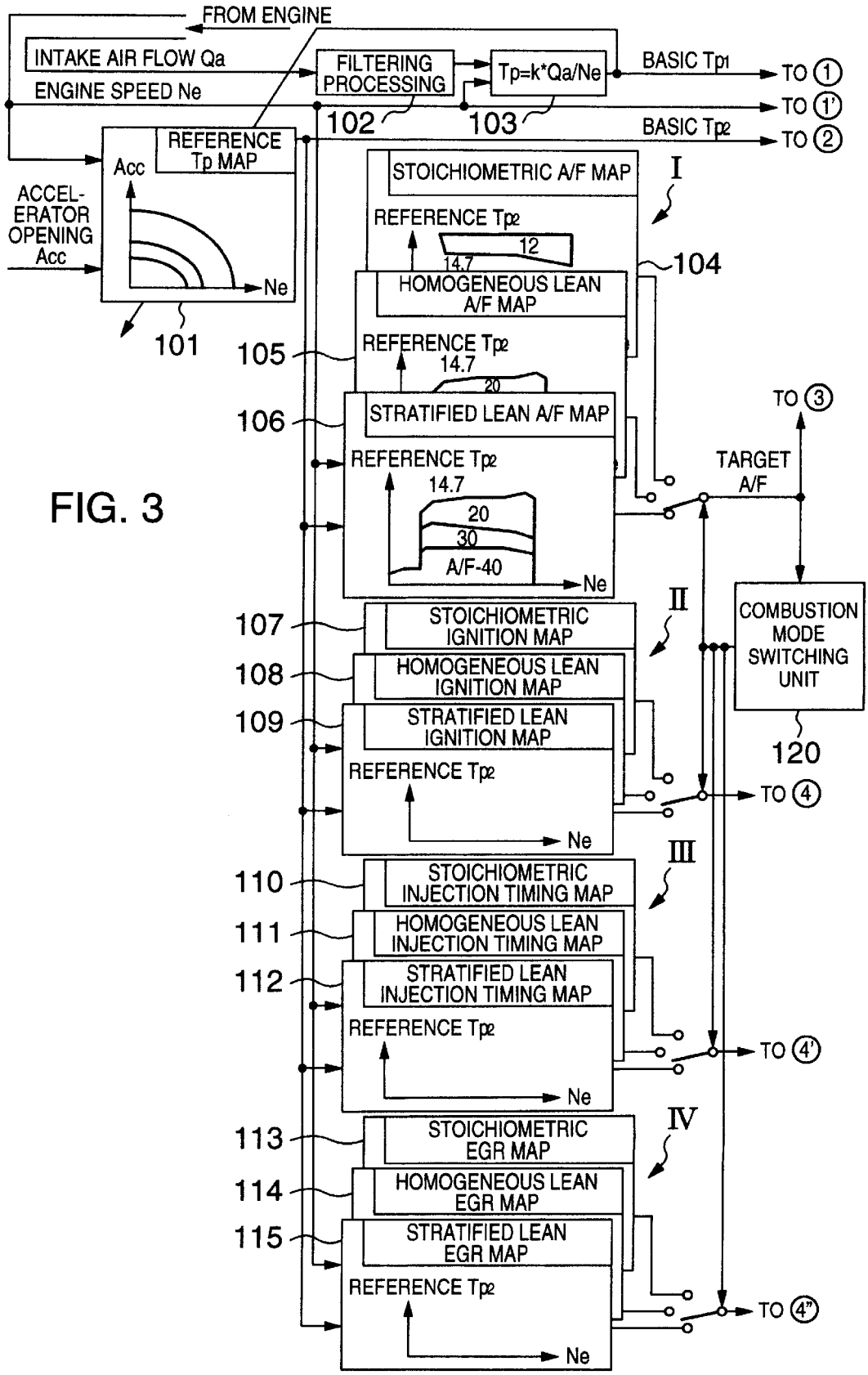
FROM ENGINE
INTAKE AIR FLOW Qa
ENGINE SPEED Ne
FILTERING PROCESSING
Tp=k*Qa/Ne
BASIC Tp1
TO 1
TO 1'
BASIC Tp2
TO 2
102
103
REFERENCE Tp MAP
Acc
ACCEL-ERATOR OPENING Acc
Ne
101
STOICHIOMETRIC A/F MAP
I
REFERENCE Tp2
12
14.7
104
HOMOGENEOUS LEAN A/F MAP
105
REFERENCE Tp2
14.7
20
106
STRATIFIED LEAN A/F MAP
REFERENCE Tp2
14.7
20
30
A/F-40
Ne
TO 3
TARGET A/F
FIG. 3
II
107
STOICHIOMETRIC IGNITION MAP
108
HOMOGENEOUS LEAN IGNITION MAP
109
STRATIFIED LEAN IGNITION MAP
REFERENCE Tp2
Ne
COMBUSTION MODE SWITCHING UNIT
120
TO 4
III
110
STOICHIOMETRIC INJECTION TIMING MAP
111
HOMOGENEOUS LEAN INJECTION TIMING MAP
112
STRATIFIED LEAN INJECTION TIMING MAP
REFERENCE Tp2
Ne
TO 4'
IV
113
STOICHIOMETRIC EGR MAP
114
HOMOGENEOUS LEAN EGR MAP
115
STRATIFIED LEAN EGR MAP
REFERENCE Tp2
Ne
TO 4"

FIG. 10
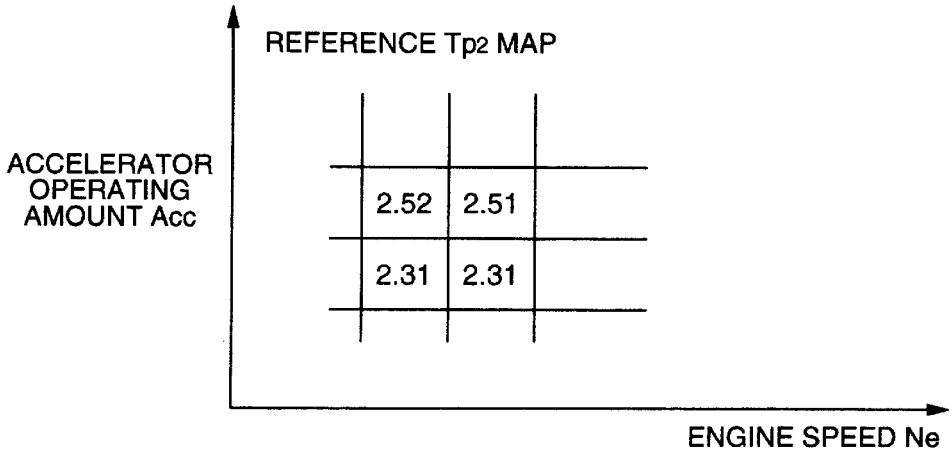
FIG. 11
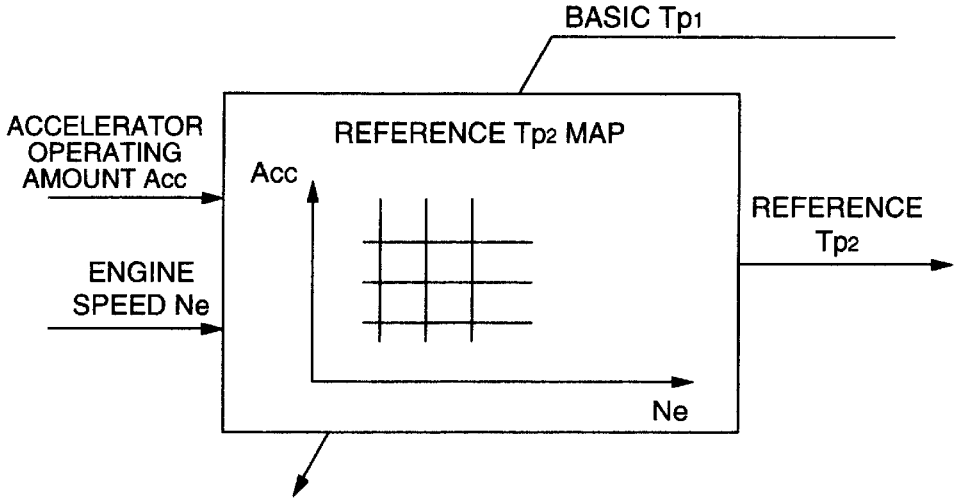
FIG. 12
REFERENCE Tp2 TABLE
| ACCELERATOR OPERATING AMOUNT Acc(deg) | ··· | 4 | 8 | ··· |
|---|---|---|---|---|
| REFERENCE Tp2(ms) | ··· | 2.31 | 2.52 | ··· |

CONTROL APPARATUS OF ENGINE WITH ELECTRONICALLY DRIVEN INTAKE AND EXHAUST VALVES

BACKGROUND OF THE INVENTION

The present invention relates to a control apparatus of an engine with electromagnetically driven intake and exhaust valves and more particularly, to an engine control apparatus with electromagnetically driven intake and exhaust valves which can provide a wide dynamic range of engine brake torque even during fuel cut by controlling the valve open timing of the electromagnetically driven exhaust valve.

A technique disclosed in, for example, JP-A-63-147957 has hitherto been known in which by changing the valve timing of an electromagnetically driven valve, the engine brake effect can be obtained and the torque shock and pumping loss can be decreased. More particularly, in the technique, the valve timing of the intake valve is set to normal timing during deceleration fuel cut and is switched to the early close timing immediately before the fuel cut ends, that is, fuel supply is resumed.

However, the valve switching timing described in the conventional technique as above is set to two stages of normal timing and early close timing and therefore, when the early close timing always proceeds during the fuel cut, the pumping loss is decreased excessively to raise a disadvantage that the engine brake effect becomes insufficient.

Then, a technique has been proposed in JP-A-9-88645, according to which the valve open timing of the intake valve is controlled more finely under a predetermined running condition for fuel cut, thereby decreasing the pumping loss and providing suitable engine brake.

SUMMARY OF THE INVENTION

In the aforementioned technique, the pumping loss can be decreased and suitable engine brake can be obtained by stopping the fuel supply to the engine and correcting the valve open time of the electromagnetically driven intake valve so as to decrease it when a predetermined deceleration condition of the engine is detected but the object to be controlled is the intake valve and the valve open time during intake stroke is controlled, raising a problem that the dynamic range of the engine brake torque cannot be widened.

Further, in a kind of engine system having no throttle valve, the pumping loss does not take place, raising a problem that the engine brake torque per se cannot be obtained.

The present invention contemplates elimination of the above problems and it is an object of the present invention to provide an in-cylinder injection engine control apparatus which can widen the dynamic range of engine brake torque.

To accomplish the above object, an engine control apparatus with electromagnetically driven intake and exhaust valves according to the invention comprises valve control means including fuel injection timed valve controlling means, fuel cut timed valve controlling means and means for controlling drive of intake and exhaust valves on the basis of output signals of the above two means, wherein the fuel cut timed valve controlling means includes exhaust valve open/close timing calculating means for making the valve open timing of the exhaust valve earlier than the fuel injection timing during fuel cut, and the valve control means includes fuel cut deciding means for determining fuel cut under at least one condition that the accelerator operating amount (accelerator pedal depression amount) is detected as being near zero and valve drive changing means for switching an output signal from the fuel injection timed valve controlling means to an output signal of the fuel cut timed valve controlling means when the fuel cut is determined.

In the engine control apparatus with electromagnetically driven intake and exhaust valves according to the invention constructed as above, when fuel is cut with the accelerator operating amount detected as being near zero, the valve open timing of the exhaust valve can be made to be earlier than the fuel injection timing and consequently, sufficient engine brake torque can be obtained.

Also, by controlling the valve open timing of the exhaust valve during the fuel cut to make it variable between the early stage of expansion stroke (near TDC) and the late stage thereof (near BDC), the magnitude of engine brake torque can be controlled and the variable range of the valve open timing can be widened, thereby widening the dynamic range of the engine brake torque.

Further, when large braking torque is required, the valve open timing of the exhaust valve is caused to approach the early stage of expansion stroke (near TDC) and when small braking torque is required, the valve open timing of the exhaust valve is caused to approach the late stage of expansion stroke (near BDC), thereby ensuring that the magnitude of engine brake torque can be controlled.

Furthermore, by gradually advancing the valve open timing of the exhaust valve during engine braking from the late stage of expansion stroke to the initial (early) stage thereof, a shock due to a rapid change of plus (firing) torque to minus (engine brake) torque caused at the time that the accelerator step-on state changes to the accelerator step-off state can be decreased.

In addition, when down shifting from the high speed side gear to the low speed side gear is effected during deceleration by means of AT (Automatic Transmission) control device, a shock during the down shifting can be decreased by changing stepwise the valve open timing of the exhaust valve from the initial or middle stage of expansion stroke to the late stage thereof concurrently with shifting to the low speed side gear and thereafter changing gradually the vale open timing of the exhaust valve from the late stage of expansion stroke to the middle or initial stage thereof to thereby increase the engine brake torque gradually and decrease a shock during down shifting.

Further, when one or more cylinders are made not work by fuel cut for traction control, by changing the valve open timing of the exhaust valve of the cylinder in which fuel cut proceeds to thereby change minus torque continuously, torque shock at a transient state of changing the number of cylinders of fuel-cut can be prevented and as a result, smooth traction control can be ensured.

Furthermore, by providing a re-triggerable delay timer which is turned on for a predetermined time when the slip rate of the wheel is larger than a threshold value during ABS control and which is restarted to be turned on for the predetermined time from a time point at which the slip rate of the wheel again exceeds the threshold value within the on-time, the engine brake torque can be decreased when the slip rate is high, causing the effect of ABS control to fulfil itself.

Besides, when the road surface condition is good with the slip rate decreased and the engine brake torque is allowed to be applied, sufficient braking force can be obtained regardless of actuation/non-actuation of the ABS.

Further, when basic fuel injection quantity $Tp_1$, reference fuel injection quantity $Tp_2$ and target fuel injection quantity $Tp_3$ are determined and intake air flow Qa is feedback-controlled to cause the basic fuel injection quantity $Tp_1$ to follow the target fuel injection quantity $Tp_3$, the valve open timing of the intake valve is calculated as an intermediate parameter to increase the response capability or speed of engine speed control.

At that time, the reference fuel injection quantity $Tp_2$ can be a variable retrieved through a map of engine speed axis and accelerator operating amount axis or the reference fuel injection quantity $Tp_2$ can be a variable retrieved through a table of accelerator operating amount axis.

The control parameter can include one or a plurality of parameters such as air-fuel ratio, ignition timing, fuel injection start timing, fuel injection end timing, EGR rate and magnitude of in-cylinder swirl.

Further, the control parameters may be maps retrievable in accordance with the engine speed axis and the reference fuel injection quantity $Tp_2$axis and each map may include three sheets of maps for stoichiometry, homogeneous (weak) lean and stratified (strong) lean.

Furthermore, by increasing the reference fuel injection quantity $Tp_2$ when the actual engine speed is smaller than a target engine speed and conversely, decreasing the reference fuel injection quantity $Tp_2$ when the actual engine speed is larger than the target engine speed, engine speed control during idling can be carried out suitably.

Further, by detecting that a load switch (SW) is set or turned on and increasing the reference fuel injection quantity $Tp_2$ by a predetermined amount, engine speed control during idling can be carried out more suitably.

Here, the load SW may be any one of air conditioner switch (SW), power steering switch (SW), electrical load (consumption current) switch (SW) and electric radiator fan (cooling fan) switch (SW) or a combination of a plurality of them.

Further, by increasing the reference fuel injection quantity $Tp_2$ by a predetermined amount and at the same time increasing the target engine speed by a predetermined amount when the load SW is set or turned on, engine speed control and/or load correction can be carried out during idling.

BRIEF DESCRIPTION OF THE DRAWINGS

FIG. 3 is a control block diagram of the first stage of the FIG. 1 engine control apparatus.

FIG. 10 is a diagram showing an example of a reference map in reference fuel injection quantity $Tp_2$ setting means in the FIG. 1 engine control apparatus.

FIG. 11 is a control (reference map) block diagram of the reference fuel injection quantity $Tp_2$ setting means in the FIG. 1 engine control apparatus.

FIG. 12 is a diagram showing an example of a reference table of the reference fuel injection quantity $Tp_2$ setting means in the FIG. 1 engine control apparatus.

FIG. 37 is a time chart showing an instance where the FIG. 1 engine control apparatus is applied to AT.

DESCRIPTION OF THE EMBODIMENTS

An engine control apparatus with electromagnetically driven intake and exhaust valves according to the present invention will now be described by way of example with reference to the accompanying drawings.

Figure 1:
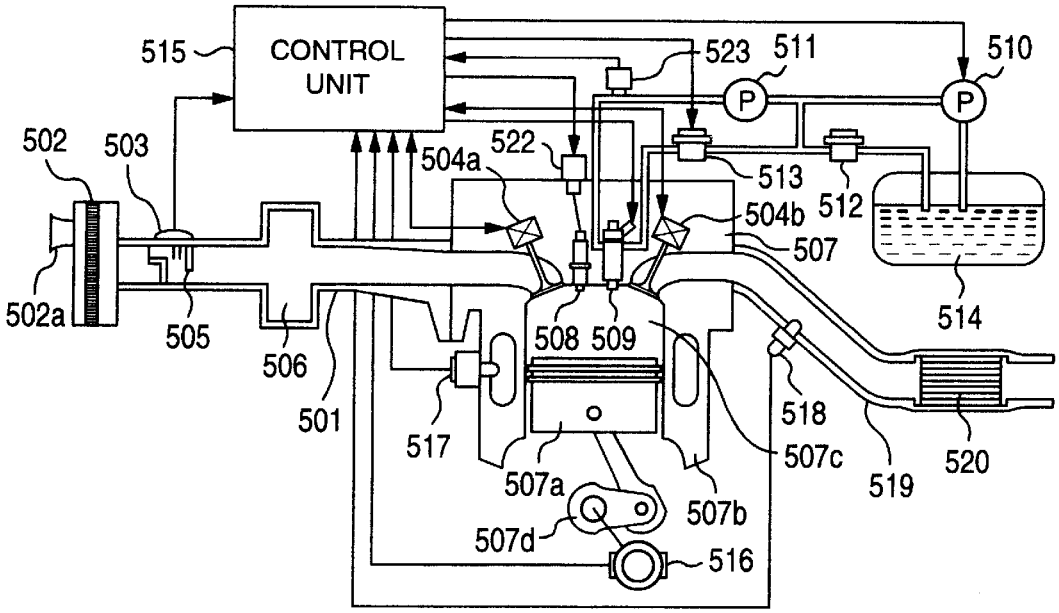
FIG. 1 is a diagram showing the overall construction of an in-cylinder injection engine system representing an embodiment of an engine control apparatus with electromagnetically driven intake and exhaust valves according to the present invention.

Referring first to FIG. 1, an in-cylinder direct injection engine system with electromagnetically driven intake and exhaust valves featuring the present invention has an overall construction as schematically illustrated therein. Structurally, an intake valve (hereinafter simply referred to as IV) 504*a* and an exhaust valve (hereinafter simply referred to as EV) 504*b* are electromagnetically driven valves (hereinafter simply referred to as EMV's) and an air flow sucked into an engine 507 is controlled in accordance with an amount of open/close of one of these valves, that is, IV 504*a*. Therefore, the throttle valve used in general engines is omitted.

In FIG. 1, air flow sucked into the engine 507 is admitted to an air cleaner 502 through its entrance 502*a* and passed through an air flow meter 503 serving as means for measurement of intake air flow Qa so as to enter a collector 506. The air sucked into the collector 506 is distributed to an intake manifold 501 communicated with the interior of individual cylinders 507*b* of the engine 507 so as to be led to the interior of a combustion room 507*c* of each cylinder 507*b*.

On the other hand, fuel such as gasoline fed from a fuel tank 514 is primarily pressurized by means of a fuel pump 510 and is then secondarily pressurized by means of a fuel pump 511. The thus pressurized fuel is supplied to a fuel system piped with injectors 509. The primarily pressurized fuel is regulated to a constant pressure (for example, 3 $kg/cm^2$) by means of a fuel pressure regulator 512 and the fuel pressurized secondarily to a higher pressure is regulated to a constant pressure (for example, 30 $kg/cm^2$) by means of a fuel pressure regulator 513, so that the finally regulated fuel is injected into each cylinder 507*b* through the injector 509 provided in association with each cylinder 507*b*. The injected fuel is ignited by an ignition plug 508 operated by a high-voltage ignition signal generated by an ignition coil 522.

A control unit 515 is connected to receive a signal indicative of an intake air flow from the air flow meter 503, a reference angle signal REF indicative of a rotational position of crank shaft 507*d* and an angle signal POS for detection of a rotation signal (engine speed), these signals being generated from a crank angle sensor 516, and an exhaust gas detection signal generated from an air-fuel ratio (hereinafter simply referred to as A/F) sensor 518 provided upstream of catalyzer 520 in an exhaust pipe 519.

Figure 2:
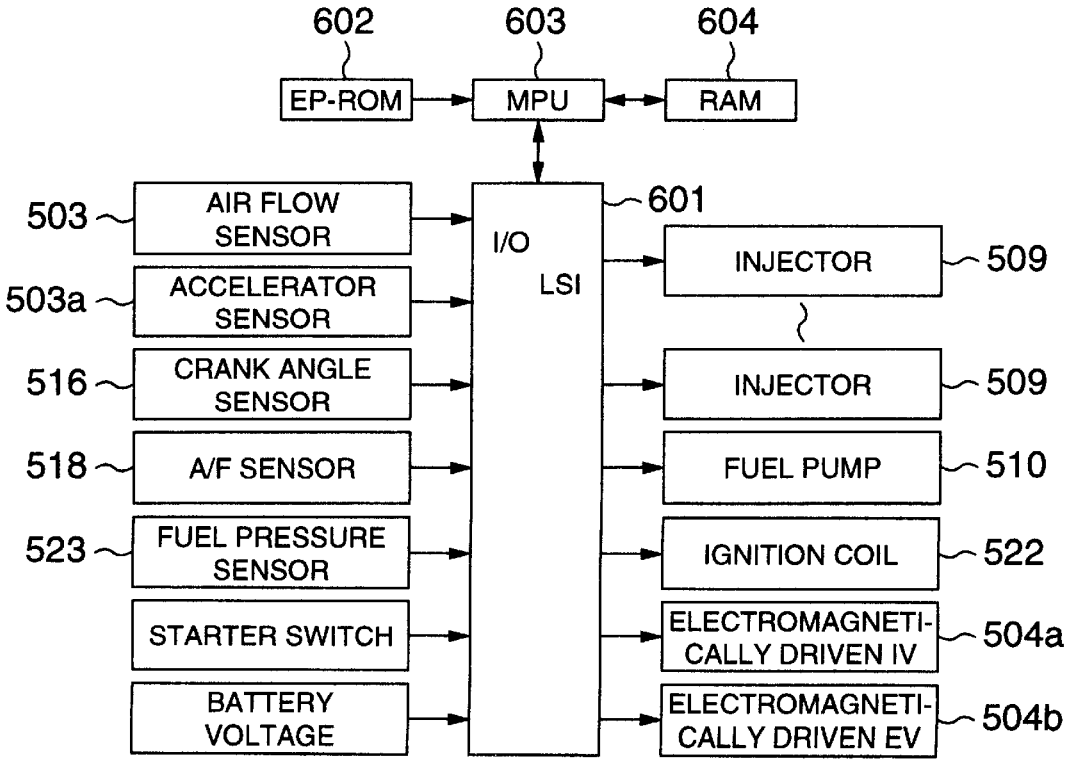
FIG. 2 is a diagram showing the internal construction of the control apparatus of the FIG. 1 engine system.

Referring to FIG. 2, the control unit 515 has principal components configured as shown therein. More particularly, the control unit 515 includes a MPU 603, a ROM 602, a RAM 604 and an input/output (I/O) LSI 601 comprised of an A/D convertor. The I/O LSI 601 is connected to receive signals from various sensors, adapted to detect the running state of the engine and including the air flow sensor 503 for measurement of intake air flow Qa, an accelerator sensor 503*a* for detection of accelerator operating amount (pedal depressed stroke), the crank angle sensor 516 for measurement of engine speed Ne, the A/F sensor 518 and a fuel pressure sensor 523.

When fetching the input signals from these various sensors, the I/O LSI 601 executes predetermined operation processes to deliver various kinds of control signals calculated in the operation process. More particularly, the I/O LSI 601 supplies predetermined control signals to the injector 509 and ignition coil 522 to execute fuel supply quantity control and ignition timing control and besides, delivers open/close control signals to the IV 504*a* and EV 504*b* to control valve open/close timings.

Figure 4:
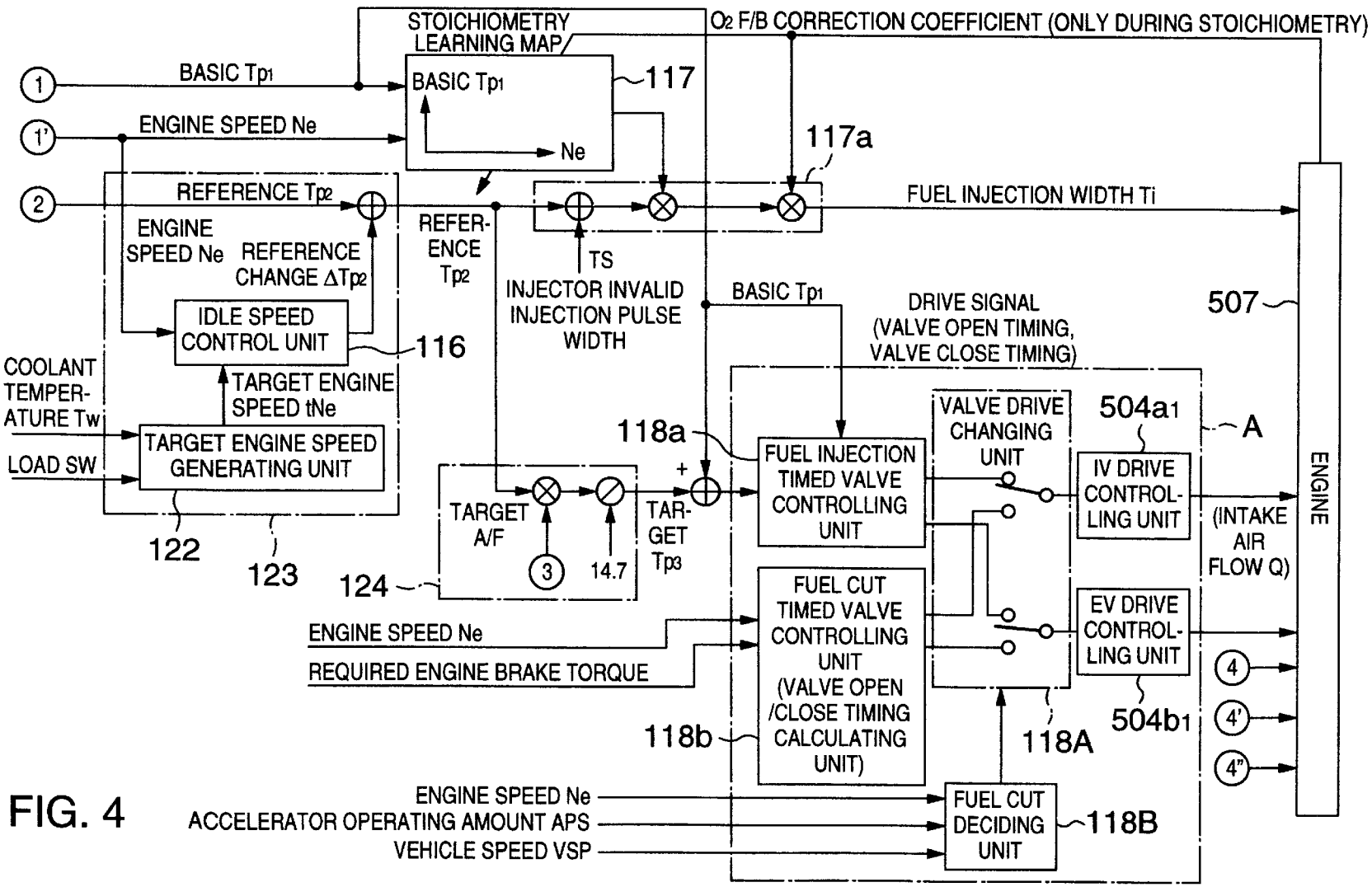
FIG. 4 is a control block diagram of the latter stage of the FIG. 1 engine control apparatus.

Referring now to FIGS. 3 and 4, there is illustrated, in block form, an outline of overall control executed by the control unit 515 in the in-cylinder injection engine 507 as above. One control block diagram is constructed by FIGS. 3 and 4. In FIG. 4, a chained-line block A indicates valve control means serving as a controller which is adapted to control the open/close timings of the electromagnetically driven IV 504*a* and EV 504*b*, playing the role of the subject of the present control apparatus. Especially, the controller is operative to perform earlier control of the valve open timing of the EV 504*b* so as to generate engine brake during fuel cut. But for convenience of explanation of the overall control of the present embodiment, the controller will be detailed later.

The intake air flow Qa detected by the air flow meter 503 is applied with a filtering process by means of filter process unit 102. Thereafter, the intake air flow Qa is divided by an engine speed Ne and multiplied by a coefficient k which makes the A/F a stoichiometric A/F equaling 14.7 in basic fuel injection quantity deciding unit 103 to thereby determine a basic fuel injection pulse width or a basic fuel injection quantity $Tp_1$ per cylinder. For the purpose of correcting differences in characteristic due to individuality of the air flow meters and differences in characteristic due to individuality of the injectors 509 as well as a shift of characteristic due to temporal change, basic fuel injection quantity correcting unit 117 learns, only under the stoichiometric condition, a correction coefficient by which the fuel injection quantity is multiplied, at each operating point determined by the basic fuel injection quantity $Tp_1$ and the engine speed Ne.

On the other hand, reference fuel injection quantity deciding unit 101 determines a reference fuel injection quantity $Tp_2$ acting as a criterion of target fuel injection quantity $Tp_3$, on the same dimension as the basic fuel injection quantity $Tp_1$ through a map of the engine speed Ne and accelerator operating amount Acc. Values of the map of the reference fuel injection quantity $Tp_2$ are set in advance in order that the basic fuel injection quantity $Tp_1$ is related to the reference fuel injection quantity $Tp_2$ in such a way that the reference fuel injection quantity $Tp_2$ during running under the stoichiometric condition coincides with the basic fuel injection quantity $Tp_1$ at the operating point determined by the accelerator operating amount Acc and the engine speed Ne. But in order for the reference fuel injection quantity $Tp_2$ to be learnt on the basis of the basic fuel injection quantity $Tp_1$under the stoichiometric condition with a view to dealing with irregularities in sensor and the like of actual cars, the map of the reference fuel injection quantity $Tp_2$ is rewritable.

In the present embodiment, maps of control parameters of engine 507 represented by the A/F, ignition timing, fuel injection timing and exhaust gas recirculation (EGR) ratio can be retrieved on axes of two variables of engine speed Ne and reference fuel injection quantity $Tp_2$. Since the reference fuel injection quantity $Tp_2$ is indicated by a function of engine load, one axis of accelerator operating amount Acc for the reference fuel injection quantity $Tp_2$ can be replaced with the axis of engine load and further, the reference fuel injection quantity $Tp_2$ coincides with the basic fuel injection quantity $Tp_1$ under the stoichiometric condition. Each map has three sheets for stoichiometric combustion, homogeneous lean combustion and stratified lean combustion.

An A/F map (I) consists of three sheets of a map 104 for stoichiometry, a map 105 for homogeneous lean and a map 106 for stratified lean, an ignition timing map (II) consists of three sheets of a map 107 for stoichiometry, a map 108 for homogeneous lean and a map 109 for stratified lean, and an ignition timing map (III) consists of three sheets of a map 110 for stoichiometry, a map 111 for homogeneous lean and a map 112 for stratified lean. Further, an EGR ratio map (IV) consists of a map 113 for stoichiometry, a map 114 for homogeneous lean and a map 115 for stratified lean. It is determined by combustion mode switching unit 120 which map in each parameter of A/F, ignition timing, combustion ignition timing or EGR ratio is used. A process by the combustion mode switching unit 120 will be detailed later.

Any of intake air flow Q and fuel injection width Ti (fuel injection quantity Tp), which are two factors for determining the running A/F of the engine, can be calculated on the basis of the reference fuel injection quantity $Tp_2$ and especially, the fuel injection width Ti (fuel injection quantity Tp) can be calculated by fuel injection width calculating unit 117*a*. More specifically, the fuel injection quantity Tp can be determined by adding a reference change quantity $\Delta Tp_2$ to the reference fuel injection quantity $Tp_2$ to provide a reference fuel injection quantity $Tp_2'$, adding an invalid injection pulse width Ts of the injector 509 to the reference fuel injection quantity $Tp_2'$, and then correcting the resulting sum with the basic fuel injection quantity $Tp_1$ and besides multiplying a resulting value by an $O_2$ feed-back correction coefficient only in case of the stoichiometric combustion.

On the other hand, the intake air flow Q is determined according to the following steps. The reference fuel injection quantity $Tp_2'$ is obtained by adding the reference change quantity $\Delta Tp_2$ to the reference fuel injection quantity $Tp_2$. $Tp_2$ is then multiplied by a target A/F (for example, 40) by means of target fuel injection quantity $Tp_3$ calculating unit 124. And the result is then divided by the stoichiometric A/F equaling 14.7 to calculate a target fuel injection quantity $Tp_3$ necessary for achieving the target A/F. However, the target fuel injection quantity $Tp_3$ is not a target value of fuel injection quantity from the standpoint of control but is used as a target value of intake air flow. By comparing the target fuel injection quantity $Tp_3$ with the basis fuel injection quantity $Tp_1$ to perform feedback control of the valve open/close timing of the IV 504*a* and causing the basic fuel injection quantity $Tp_1$ to follow the target fuel injection quantity $Tp_3$ so as to control the intake air flow, the A/F can be adjusted to a desirable value.

Next, the valve control unit A will be described. Fuel injection timed valve controlling unit 118*a* is adapted to compare the target fuel injection quantity $Tp_3$ with the basic fuel injection quantity $Tp_1$, determine valve open/close timings of the IV 504*a* and EV 504*b* in accordance with a comparison difference and deliver valve open/close control signals to IV drive controlling unit 504$a_1$ and EV drive controlling unit 504*b*. Fuel cut timed valve controlling unit 118*b* is adapted to determine valve open/close timings of the IV 504*a* and EV 504*b* in accordance with the engine speed Ne and required engine brake torque and deliver valve open/close control signals to the IV drive controlling unit 504*a*, and EV drive controlling unit 504$b_1$. The fuel cut timed valve controlling unit 118*b* is provided with valve open/close timing calculating unit which will be detailed later.

Further, control operation under the direction of the fuel injection timed valve controlling unit 118*a* or the fuel cut timed valve controlling unit 118*b* is switched by valve drive changing unit 118A controlled by fuel cut deciding unit 118B. The fuel cut deciding unit 118B decides fuel cut on the basis of the engine speed Ne, accelerator operating amount APS and vehicle speed VSP. Permission of fuel cut is limited by conditions that the accelerator is so closed as not to exceed a predetermined opening, the engine speed exceeds a predetermined value and the vehicle speed exceeds a predetermined value. In that case, the transfer switch 118A is transferred to the control side by the fuel cut timed valve controlling unit 118*b* and in case at least one of the above conditions is unsatisfied, the transfer switch 118A is transferred to the control side by the fuel injection timed valve controlling unit 118*a*.

In FIG. 4, unit 123 for increasing/decreasing the reference fuel injection quantity $Tp_2$ includes idle engine speed control unit 116 and target engine speed generating unit 122. A target engine speed tNe indicative of an input signal to the idle engine speed control unit 116 is calculated by the target engine speed generating unit 122 which is detailed in FIG. 5. The target engine speed generating unit 122 receives an input of coolant temperature TW to determine a basic engine speed during idling through a table 301 and receives a load SW to determine an additional value of engine speed which in turn is added to the basic engine speed to generate the target engine speed tNe. For example, when the air conditioner is turned on, the engine speed is increased by an additional engine speed value of 100 rpm to stabilize the engine speed.

Figure 6:
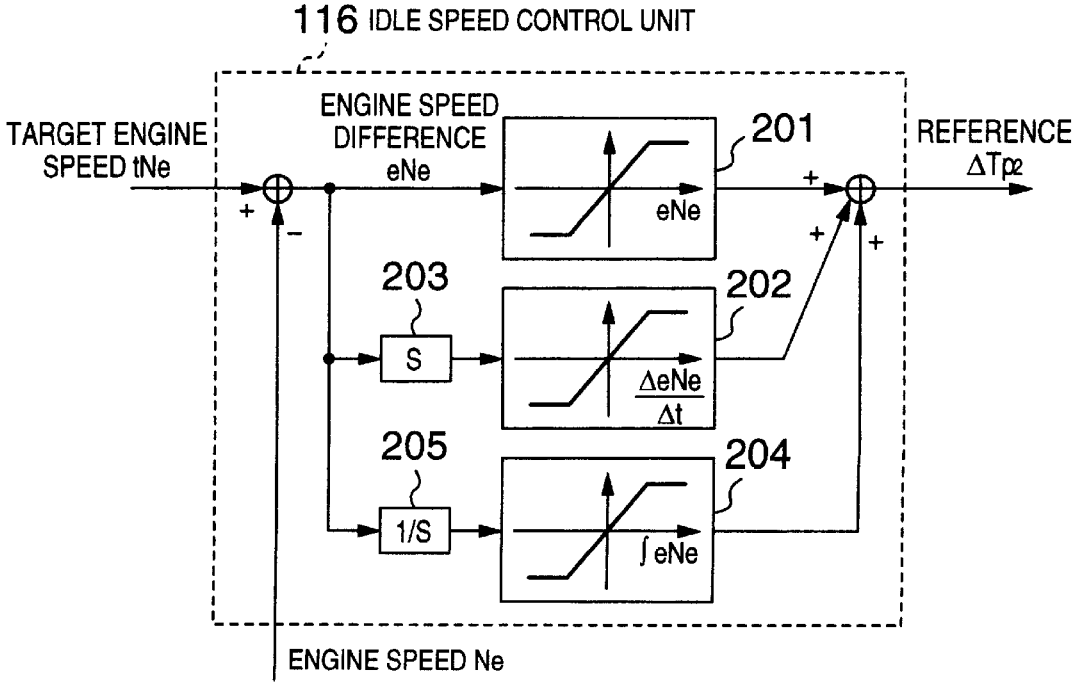
FIG. 6 is a block diagram of idle engine speed control means in the FIG. 1 engine control apparatus.

As shown in FIG. 6, in the idle engine speed control unit 116, a difference eNe between the target engine speed tNe and an actual engine speed Ne is calculated and proportional/integration/differential (PID) control is effected by using proportional, differential and integral terms of the difference to deliver a reference change quantity $\Delta Tp_2$ which is reflected on the reference fuel injection quantity $Tp_2'$. The proportional term of the difference eNe is multiplied by a gain obtained in a block 201, the term obtained by differentiating the difference by means of a differentiator 203 is multiplied by a differential gain in a block 202 and the term obtained by integrating the difference by means of an integrator 205 is multiplied by an integral gain in a block 204. Then, three components are added to each other to determine the reference change quantity $\Delta Tp_2$ of the reference fuel injection quantity $Tp_2$.

Figure 7:
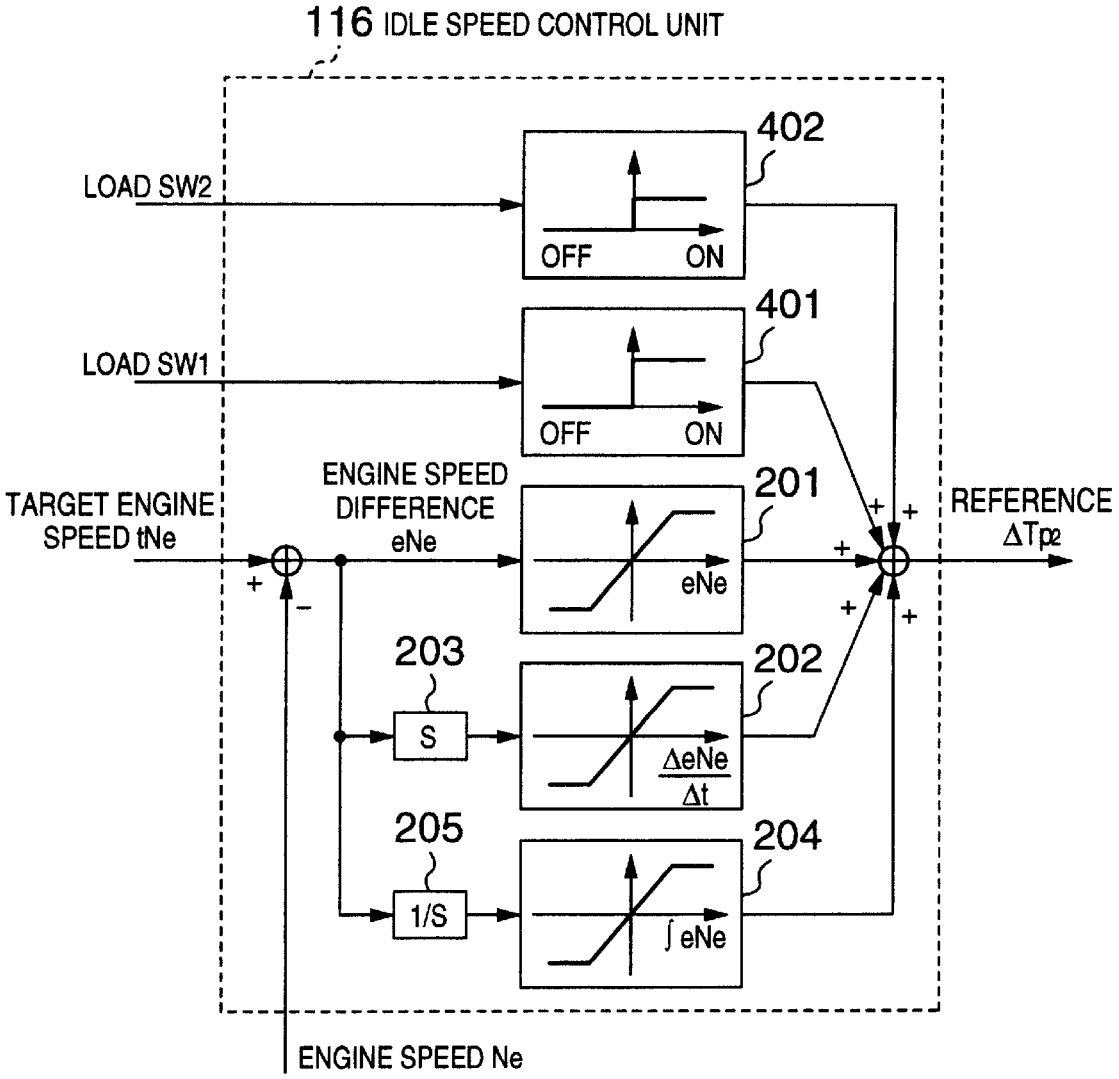
FIG. 7 is a block diagram of different idle engine speed control means in the FIG. 1 engine control apparatus.

When load is set on, amounts of fuel and air are required to be increased for not only increasing the engine speed but also maintaining the same engine speed, thereby increasing generation torque and therefore, idle engine speed control unit 116 as shown in block form in FIG. 7 is needed for load correction. The idle engine speed control unit 116 shown in FIG. 7 is based on FIG. 6, having unit indicated by blocks 401 and 402 which are adapted to increase the fuel injection quantity $Tp_2'$ when the load SW is set on. In these blocks 401 and 402, increments of reference change quantity $\Delta Tp_2$ of the reference fuel injection quantity $Tp_2$ are set in accordance with magnitude of the load.

Figure 8:
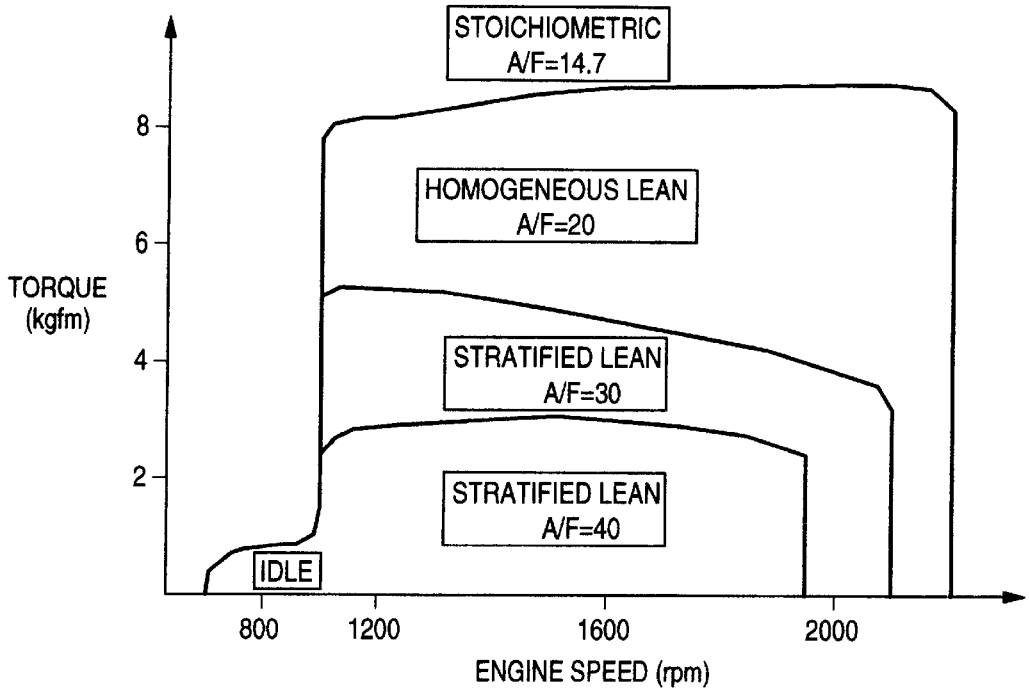
FIG. 8 is a graphic representation showing an example of setting of air/fuel ratio in the FIG. 1 engine control apparatus.

Referring to FIG. 8, there is illustrated the A/F setting map (I) of the in-cylinder injection engine 507 according to the present embodiment. This setting map is developed into the three sheets of maps for stoichiometry, homogeneous lean and stratified lean shown in FIG. 3. This map shows that the F/A is 40 in an idle area because the FIG. 8 map is for engine warm-up. During engine cooling, stable stratified lean combustion cannot proceed, leading to stoichiometric comustion and other parameters are retrieved by using their maps for stoichiometric condition.

The combustion mode as above is determined by the combustion mode switching unit 120 as shown in FIG. 3. The contents of the process will be described with reference to FIG. 9.

Figure 9:
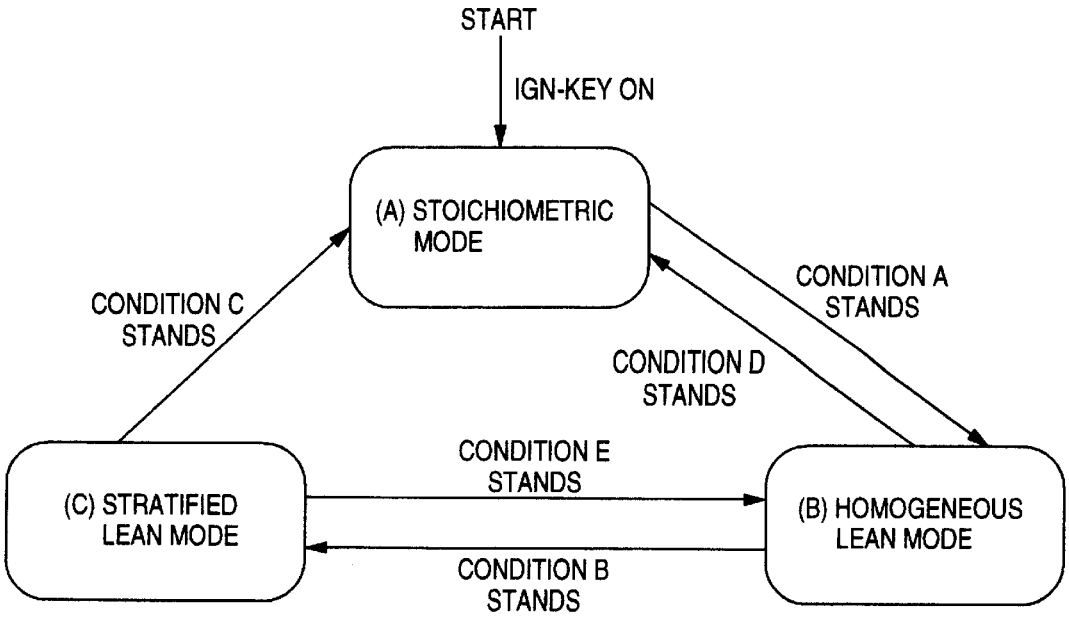
FIG. 9 is a status transition diagram in combustion mode switching means in the FIG. 1 engine control apparatus.

FIG. 9 is a state transition diagram in the combustion mode switching unit 120. During start of the engine 507, (A) stoichiometric mode is first set up. In order for the (A) stoichiometric mode to shift to (B) homogeneous mode, a condition A must stand. Further, if a condition B stands during running in the (B) homogeneous lean mode, the mode shifts to the (C) stratified lean mode. If a condition C stands during running in the (C) stratified lean mode, the mode returns to the (A) stoichiometric mode but if a condition E stands, the mode returns to the (B) homogeneous lean mode. When a condition D stands in the (B) homogeneous lean mode, the mode returns to the (A) stoichiometric mode. Examples of the respective conditions will be described below.

Condition A

A1 to A3 as below all stand, where

A1: target A/F retrieved through the Stoichiometric A/F map≧20

A2: engine cooling water temperature TWN≧40° C.

A3: enrichment coefficient after start=0

Condition B

Target A/F retrieved through the homogeneous lean A/F map≧30

Condition C

The fuel cut condition during deceleration stands

Condition D

Target A/F retrieved through the homogeneous lean A/F map≦19

Condition E

Target A/F retrieved through the stratified lean A/F map≦28

When the combustion mode is determined by means of the combustion mode switching unit 120 of FIG. 3 as described above, setting values of the ignition timing, injection timing and EGR ratio, in addition to that of the A/F, are retrieved through the corresponding maps.

Referring to FIG. 10, there is illustrated an example of a map of the FIG. 3 setting unit 101 for setting the reference fuel injection quantity $Tp_2$. The map of the reference fuel injection quantity $Tp_2$ is a map in which retrieval is effected in accordance with two variables of engine speed Ne and accelerator operating amount Acc.

Setting values in the map of the reference fuel injection quantity $Tp_2$ are preset in such a way that the reference fuel injection quantity $Tp_2$ coincides with the basic fuel injection quantity $Tp_1$ during running under the stoichiometric condition. But, as shown in FIG. 11, the map of the reference fuel injection quantity $Tp_2$ is rewritable to ensure that the reference fuel injection quantity $Tp_2$ can be learnt on the basis of the basic fuel injection quantity $Tp_1$ under the stoichiometric condition even when individual sensors are non-uniform in actual vehicles.

Figure 13:
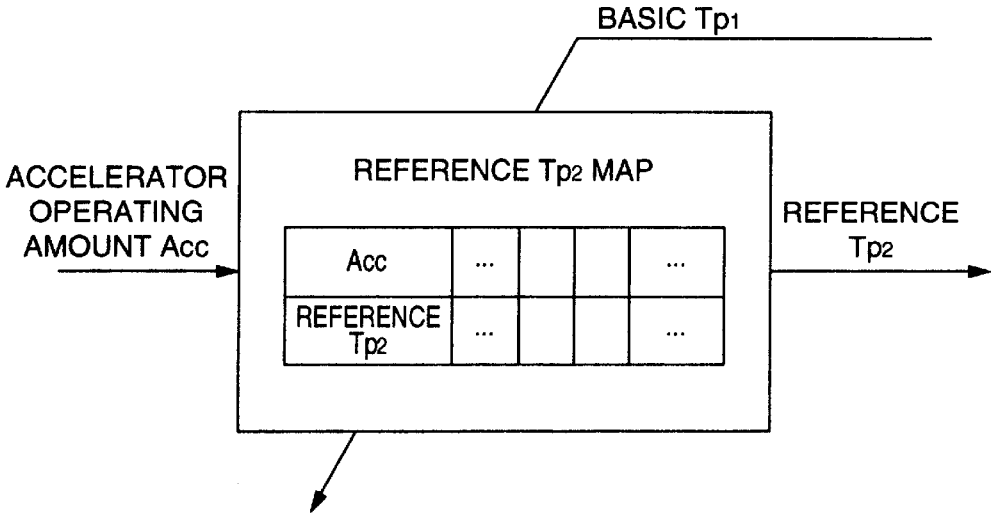
FIG. 13 is a control (reference table) block diagram of the reference fuel injection quantity $Tp_2$ setting means in the FIG. 1 engine control apparatus.

Referring now to FIG. 12, there is illustrated an example of a table in which the reference fuel injection quantity $Tp_2$ is set in accordance with the accelerator operating amount. In this example, too, setting values in the table of the reference fuel injection quantity $Tp_2$ are preset in such a way that the reference fuel injection quantity $Tp_2$ coincides with the basic fuel injection quantity $Tp_1$ when running is effected under the stoichiometric condition. But, as shown in FIG. 13, the table of the reference fuel injection quantity $Tp_2$ is rewritable to ensure that the reference fuel injection quantity $Tp_2$ can be learnt on the basis of the basic fuel injection quantity $Tp_1$ under the stoichiometric condition even when individual sensors are non-uniform in actual vehicles.

Figure 14:
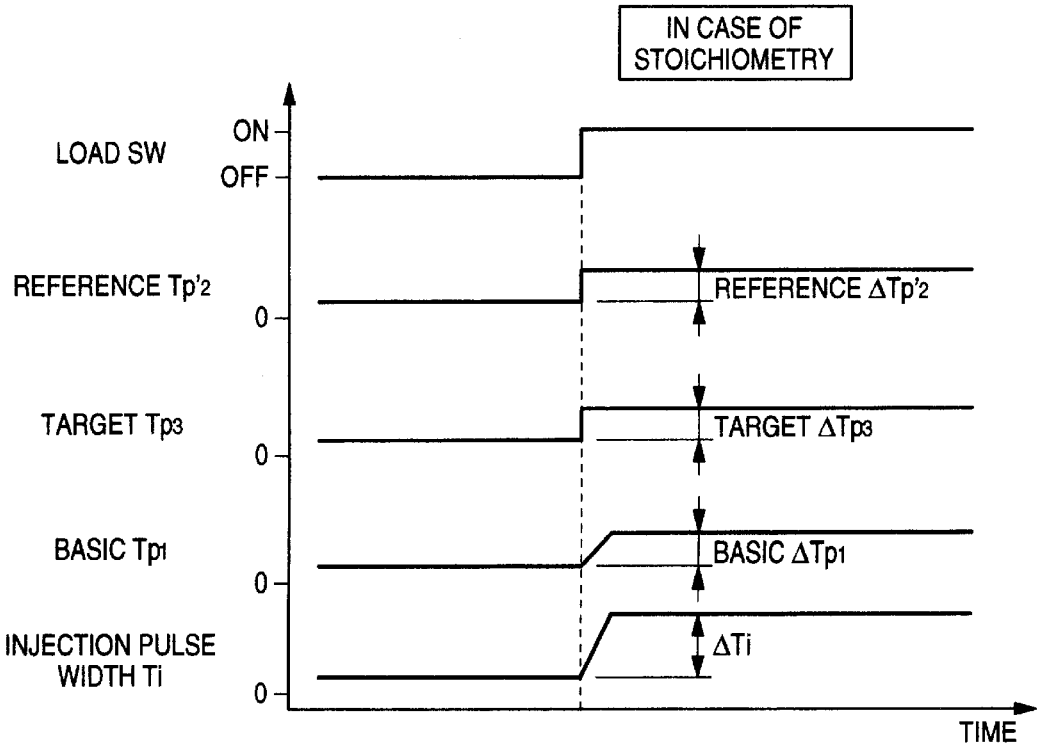
FIG. 14 is a time chart of control operation (exemplified in terms of stoichiometric combustion) in the FIG. 1 engine control apparatus.

FIG. 14 shows a time chart when a load switch (hereinafter simply referred to as load SW) is set on under the stoichiometric condition. With the load SW set on, the reference fuel injection quantity $Tp_2'$ is increased through the block 402 in FIG. 7 and the target fuel injection quantity $Tp_3$ is also increased by the same amount. In other words, a change quantity $\Delta Tp_2'$ in reference fuel injection quantity equals a change quantity $\Delta Tp_3$ in target fuel injection quantity in FIG. 14. As the reference fuel injection quantity $Tp_2'$ increases, the fuel injection width Ti is increased to raise the fuel amount and at the same time, as the target fuel injection quantity $Tp_3$ increases, the intake air flow Qa is increased by prolonging the IV open time while performing feedback of the basic fuel injection quantity $Tp_1$.

Figure 15:
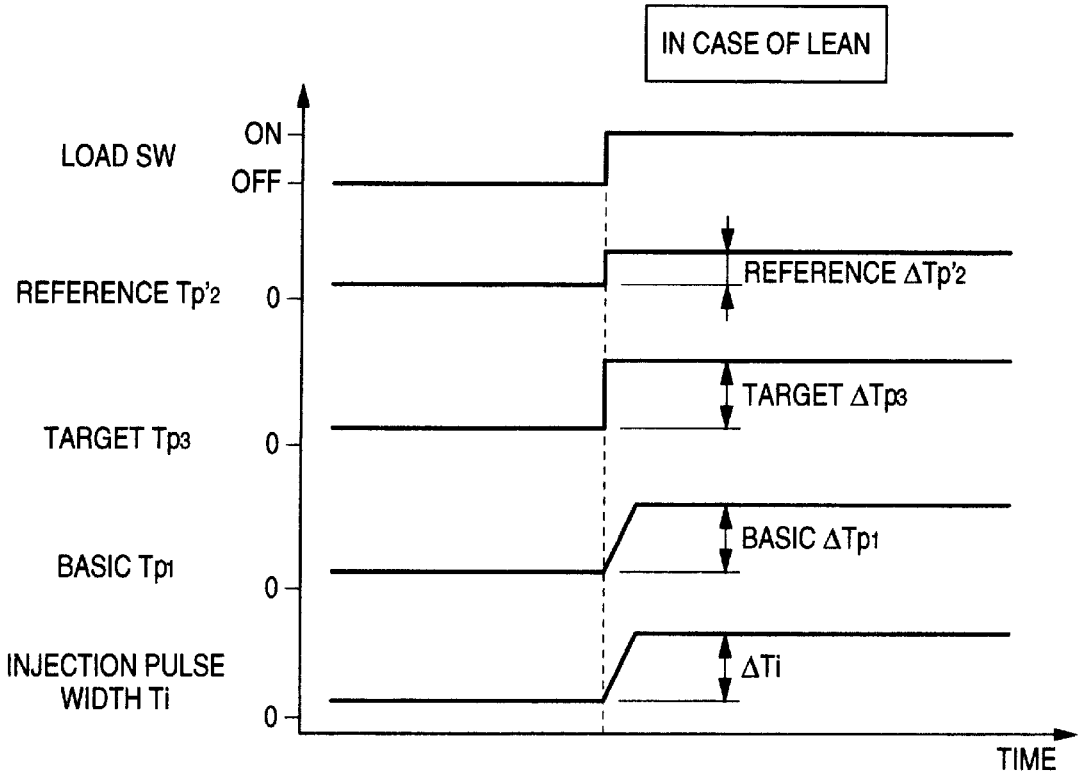
FIG. 15 is a time chart of control operation (exemplified in terms of lean combustion) in the FIG. 1 engine control apparatus.

FIG. 15 shows a time chart in case of lean combustion (stratified lean or homogeneous lean combustion), comparable to the stoichiometric combustion of FIG. 14. As shown in FIG. 15, when the load SW is set on, the reference fuel injection quantity $Tp_2$ is increased through the block 402 in FIG. 7. This causes the fuel injection width Ti to increase so as to raise the fuel amount as in the case of stoichiometric condition. In case of lean combustion, however, the target fuel injection quantity $Tp_3$ is calculated by multiplying the reference fuel injection quantity $Tp_2'$ by the target A/F (for example, 40) and dividing the product by the stoichiometric A/F equaling 14.7, so that the target fuel injection quantity $Tp_3$ becomes greater than that in case of the stoichiometric combustion. In other words, a change quantity $\Delta Tp_3$ in fuel injection quantity $Tp_3$ in FIG. 15 is greater than the change quantity $\Delta Tp_3$ in target fuel injection quantity $Tp_3$ in FIG. 14 by the ratio between the A/F's. By prolonging the IV open time by an increased amount of the target fuel injection quantity $Tp_3$ while performing feedback of the basic fuel injection quantity Tp1, the intake air flow Qa is increased.

Figure 5:
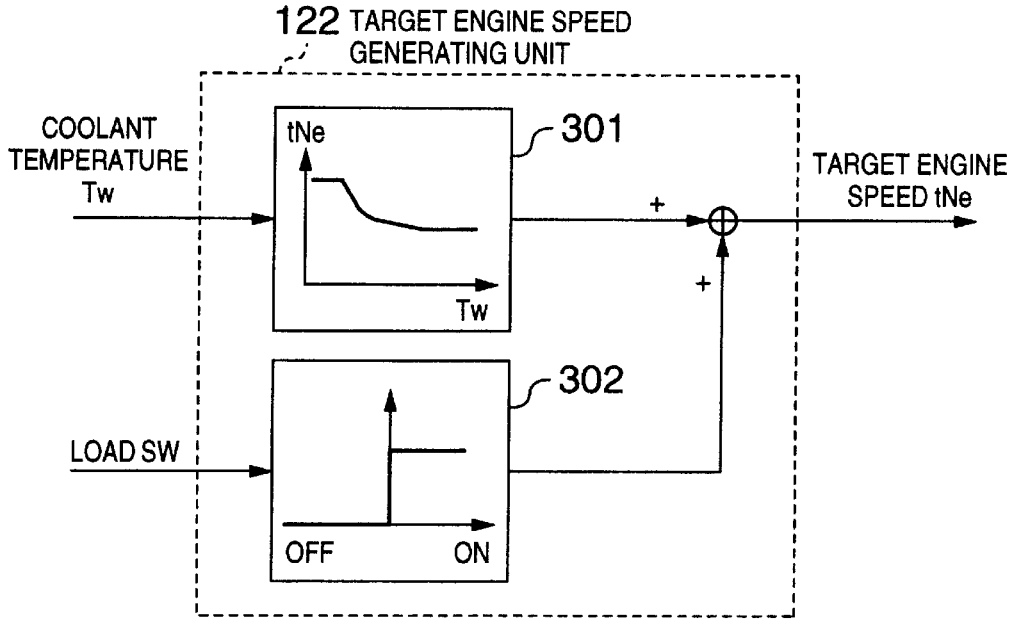
FIG. 5 is a block diagram of target engine speed generating means in the FIG. 1 engine control apparatus.
Figure 16:
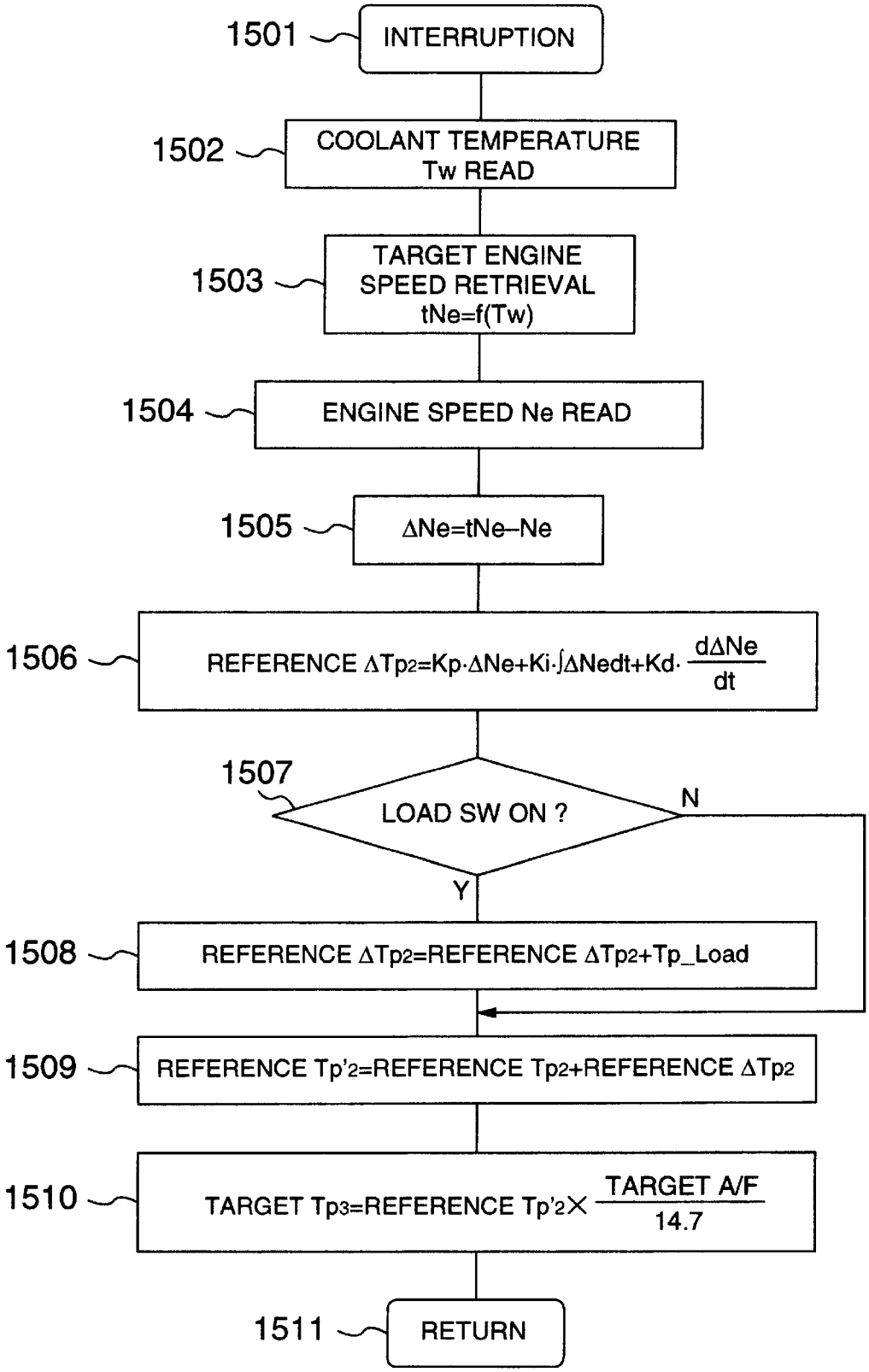
FIG. 16 is a flow chart of control operation in the FIG. 1 engine control apparatus.

Referring now to FIG. 16, there is illustrated a flow chart showing the process on software in the target engine speed generating unit 122 shown in FIG. 5 and the idle engine speed control unit 116 shown in FIG. 6.

In interruption 1501, the process is restarted every constant time and setting is so effected as to carry out the FIG. 16 process, for example, every 10 ms. In step 1502, engine cooling water temperature TW is read and in step 1503, target engine speed tNe is retrieved through the table of cooling water temperature. In step 1504, engine speed Ne is read and in step 1505, difference ΔNe from the target engine speed tNe is calculated. In step 1506, PID control operation is carried out in which proportional, integral and differential terms of the difference ΔNe are multiplied by gains and the resulting products are added to provide reference change quantity $\Delta Tp_2$ in reference fuel injection quantity $Tp_2$. Next, in step 1507, it is decided whether the load SW is on or off and if the load SW is set on, the program proceeds to step 1508. In the step 1508, the reference change quantity $\Delta Tp_2$ in reference fuel injection quantity $Tp_2$ is added with Tp Load set in accordance with the load and then the program proceeds to step 1509. If the absence of load is determined in the step 1507, the program proceeds directly to the step 1509. In the step 1509, reference fuel injection quantity $Tp_2'$ is determined by adding the reference change quantity $\Delta Tp_2$ to the reference fuel injection quantity $Tp_2$. In step 1510, target fuel injection quantity $Tp_3$ is calculated by multiplying the reference fuel injection quantity $Tp_2'$ by a target A/F and dividing the product by the stoichiometric A/F equaling 14.7. The program is returned in step 1511.

Figure 17:
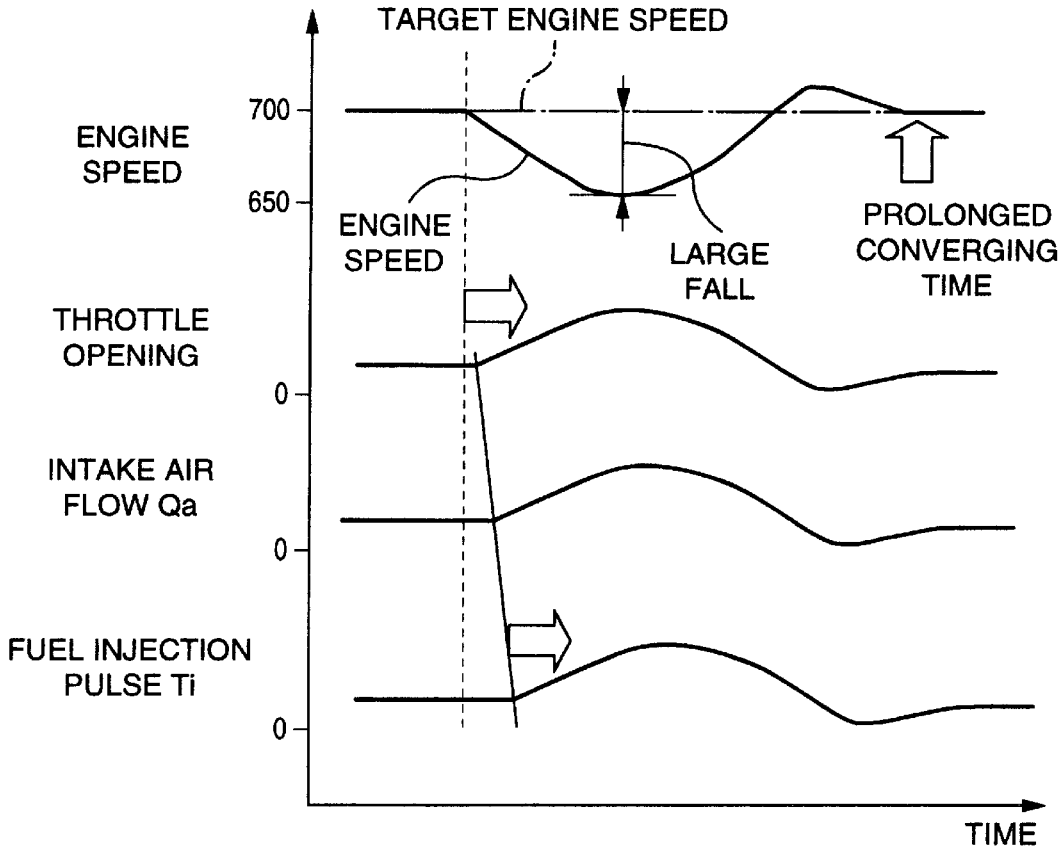
FIG. 17 is a time chart of control operation in a conventional engine control apparatus.
Figure 18:
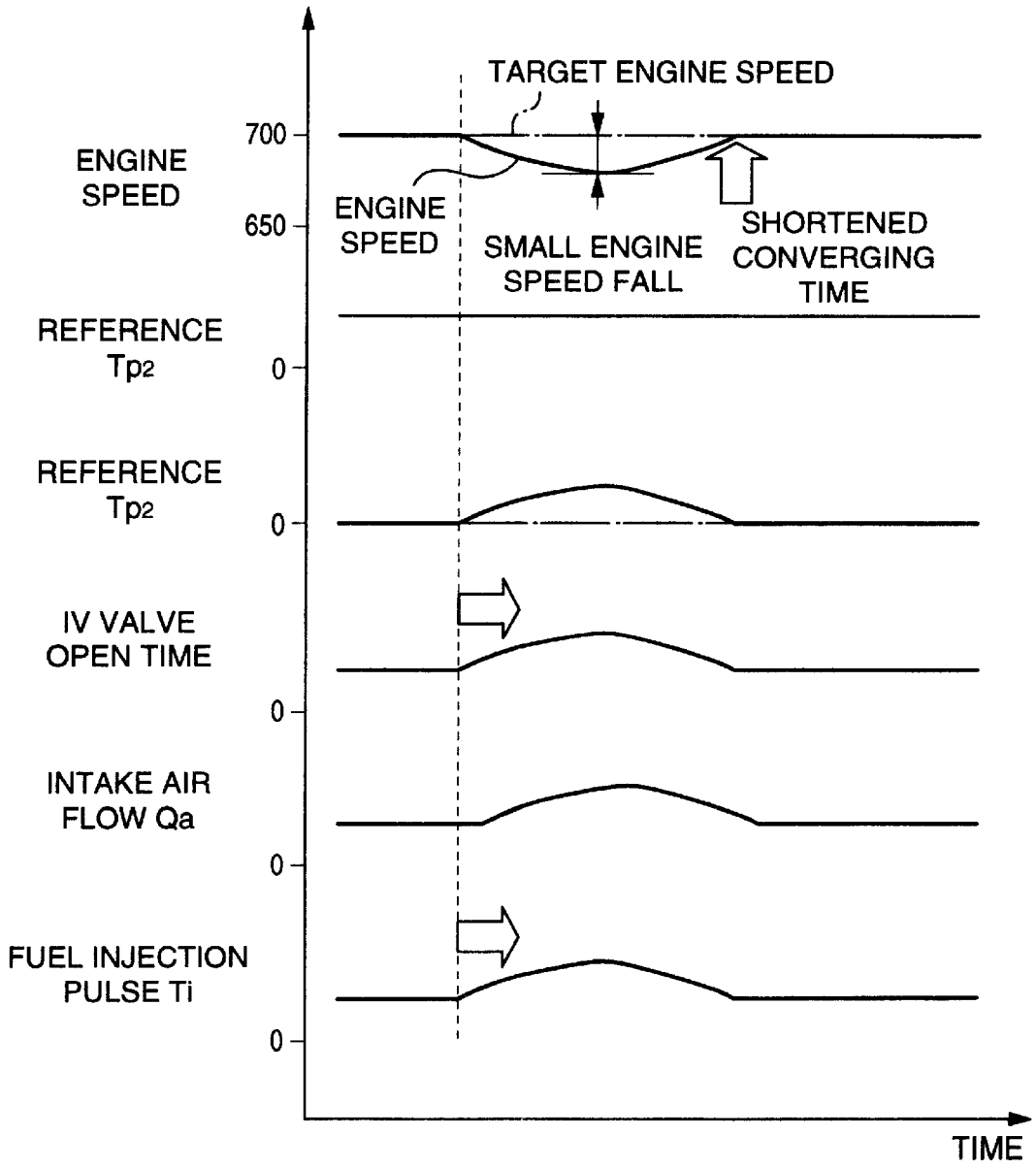
FIG. 18 is a time chart of control operation in the FIG. 1 engine control apparatus.

Turning to FIGS. 17 and 18, individual parameters in engine speed control during idling are indicated, with FIG. 17 showing an example in the conventional control and FIG. 18 showing an example of control in the present embodiment. In FIG. 17, when the engine speed falls below a target engine speed, the throttle opening is controlled toward open and as a result, intake air flow Qa is increased. With the intake air flow Qa increased, the fuel injection width Ti increases to turn the engine speed to increasing.

On the other hand, in the control shown in FIG. 18 to which the present embodiment is applied, as the engine speed falls below a target engine speed, the reference change quantity $\Delta Tp_2$ in reference fuel injection quantity $Tp_2$ increases, so that an increase in the fuel injection width Ti takes place concurrently with an increase in the IV open time, thereby rapidly turning the engine speed to increasing. Accordingly, as compared to the conventional example of FIG. 17, a drop in the engine speed can be suppressed to ensure a good response capability in control which makes the converging time short.

Figure 19:
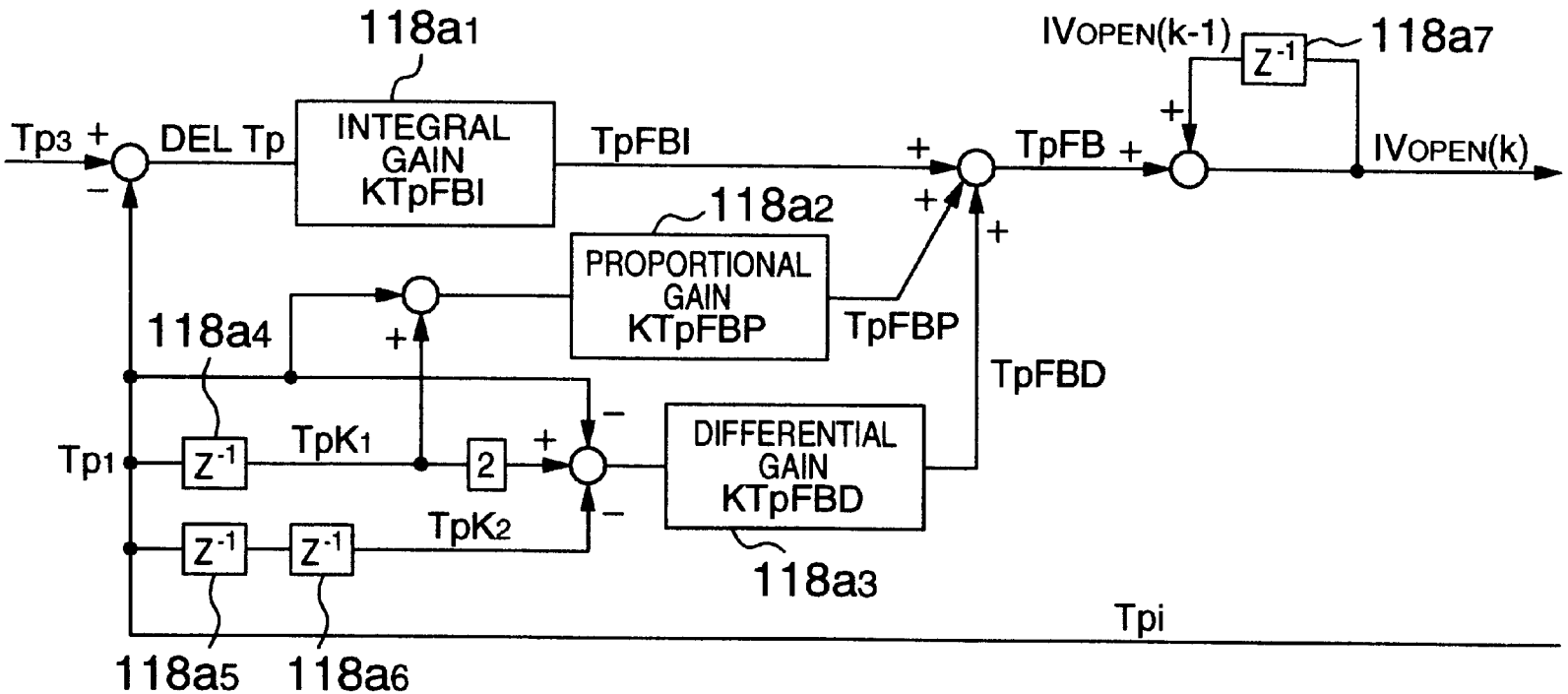
FIG. 19 is a block diagram showing the internal construction of fuel injection timed valve controlling means in FIG. 4.

FIG. 19 shows the internal construction of the fuel injection timed valve controlling unit 118*a* of FIG. 4. Firstly, a difference DEL Tp between target fuel injection quantity $Tp_3$ and basic fuel injection quantity $Tp_1$ is multiplied by an integral gain kTpFBI to determine TpFBI. A differential of the basic fuel injection quantity $Tp_1$ is multiplied by a proportional gain to determine TpFBP. Further, a second differential of the basic injection quantity $Tp_1$ is multiplied by a differential gain to determine TpFBD.

Then, the TpFBI, TpFBP and TpFBD are totaled to TpFB which in turn is added to previously calculated IV open time IVopen(k−1). Through the addition, integration proceeds to thereby change the order such that the second differential is changed to first differential and the differential is changed to proportion. In this manner, the valve open time of the IV 504*a* is determined.

Figure 20:
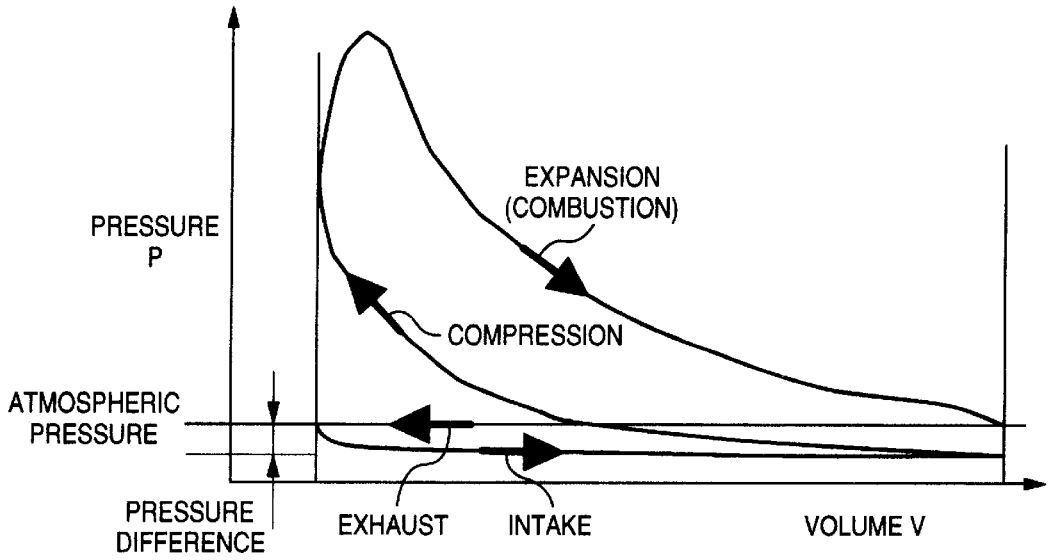
FIG. 20 is a graph showing a typical P-V diagram of a cycle of an engine.
Figure 21:
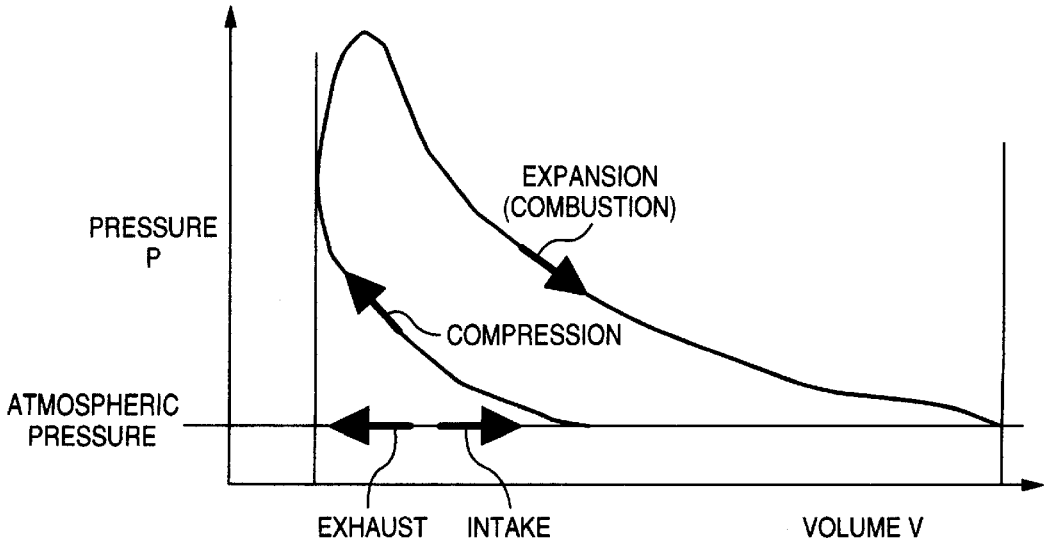
FIG. 21 is a graph showing a cycle of the FIG. 1 engine.

FIG. 20 shows a P-V diagram of a typical cycle of the general engine having the throttle valve and FIG. 21 shows a cycle of the engine having the electromagnetically driven IV 504*a* and EV 504*b* featuring the present embodiment.

As will be seen from comparison of the FIG. 20 cycle of the general engine having the throttle valve and the FIG. 21 cycle of the engine based on the EMV's, a difference between exhaust and intake pressures (pumping loss) in relation to an atmospheric criterion is eliminated to have the advantage of fuel consumption in the present embodiment.

Figure 22:
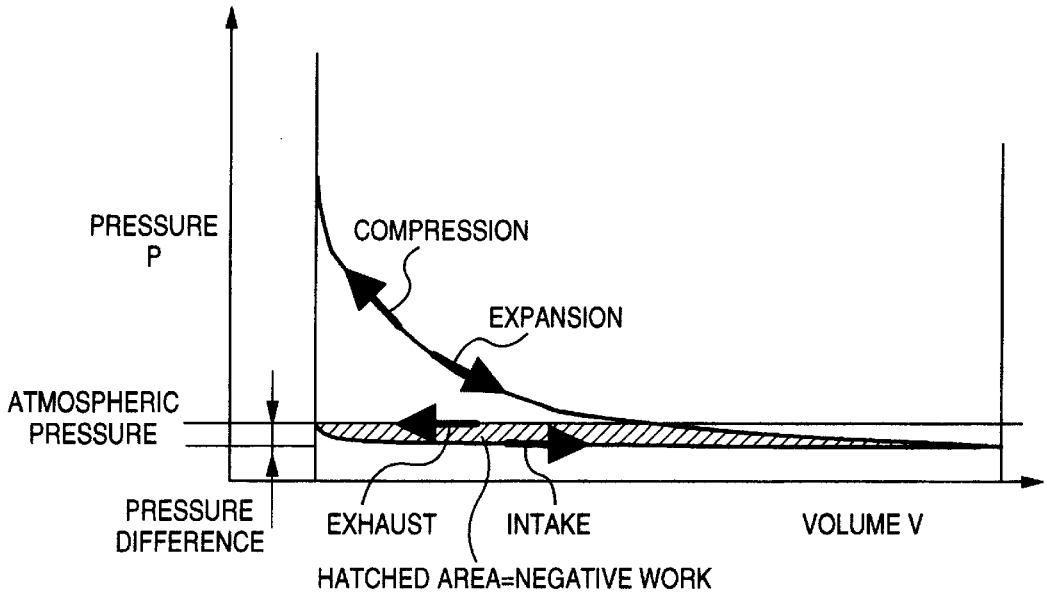
FIG. 22 is a graph showing a cycle during fuel cut in the general engine.
Figure 23:
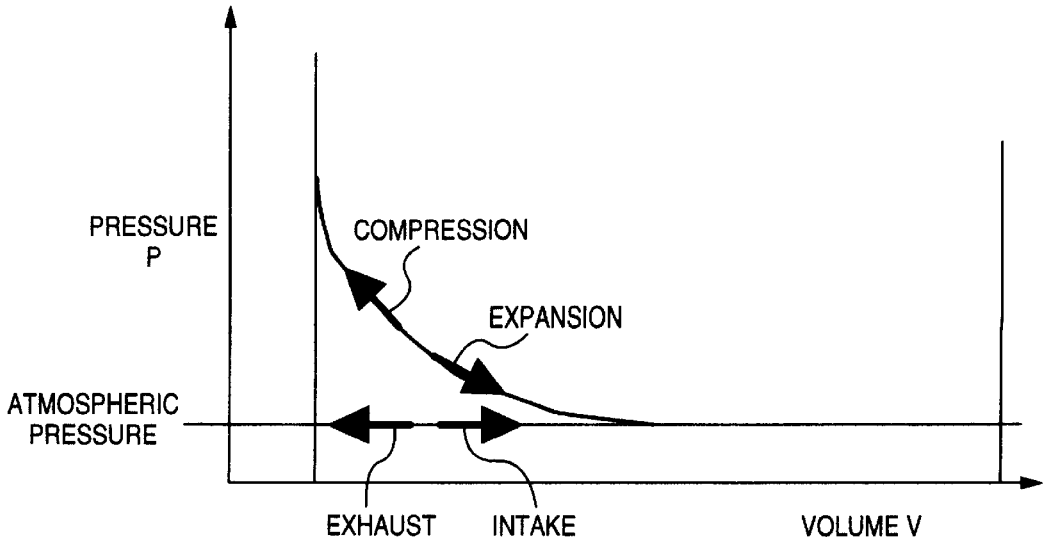
FIG. 23 is a graph showing a cycle during fuel cut in the FIG. 1 engine.

However, during fuel cut, engine brake is generated owing to a hatched area equaling minus work in a cycle shown in FIG. 22 of the general engine having the throttle valve whereas in a cycle shown in FIG. 23 of the engine of the present embodiment, minus work is not generated, failing to generate engine brake.

Figure 24:
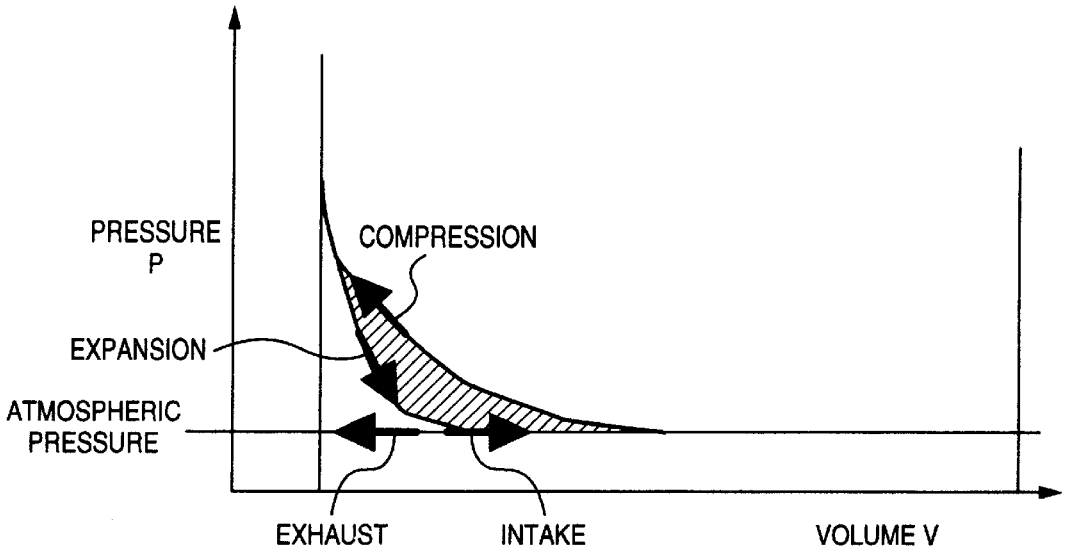
FIG. 24 is a graph showing a cycle relating to engine brake control in the FIG. 1 engine to indicate an example where the valve open timing is advanced or made to be earlier.
Figure 25:
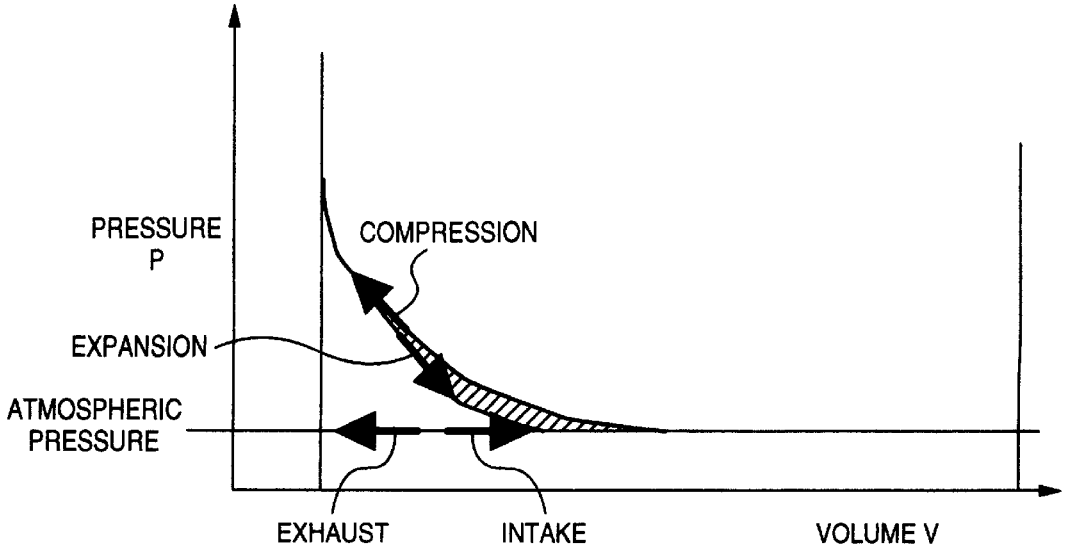
FIG. 25 is a graph showing a cycle relating to engine brake control in the FIG. 1 engine to indicate an example where the valve open timing is retarded.

Accordingly, in the present embodiment, the EV 504*b* is opened during expansion to generate a hatched area equaling minus work as shown in FIG. 24, thus succeeding in generating engine brake. However, in the example of FIG. 24, the valve open time of the EV 504*b* is advanced but in case the valve open time is retarded, the hatched area is narrowed as shown in FIG. 25. This unit that by advancing or retarding the valve open time of the EV 504*b*, the magnitude of engine brake can be controlled. Applications of controlling the magnitude of engine brake will be detailed later.

Figure 26:
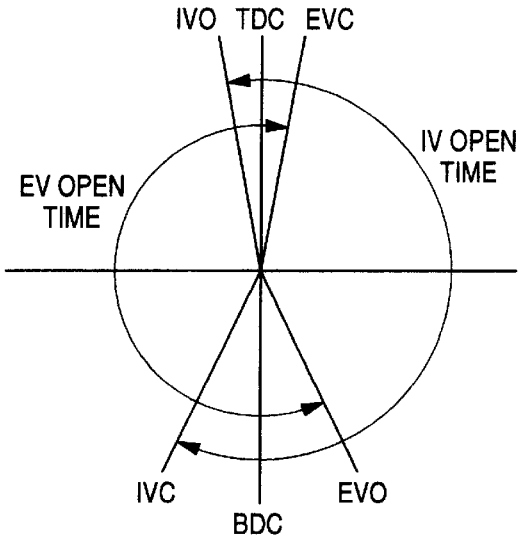
FIG. 26 is a diagram showing open/close timings of cam driven valves in the general engine.
Figure 27:
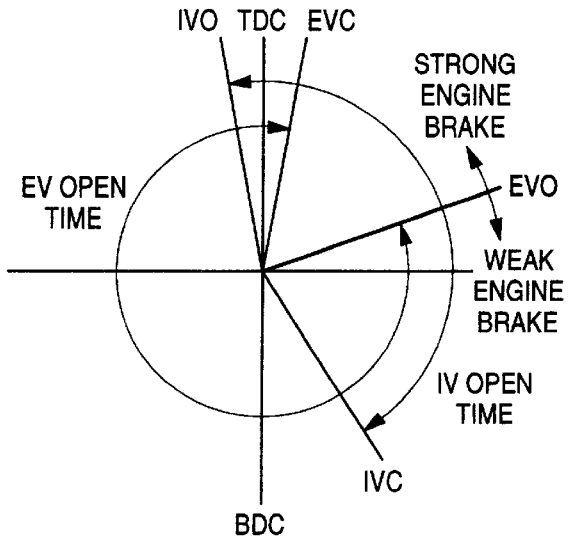
FIG. 27 is a diagram showing open/close timings of electromagnetically driven intake and exhaust valves in the FIG. 1 engine.

For comparison of open/close timings of the IV and EV, FIG. 26 shows timings of the general cam driven valves and FIG. 27 shows timings of the EMV's according to the present embodiment.

Firstly, timings of the general cam driven valves are such that as shown in FIG. 26, the IV is opened (IVO) immediately before the top dead center (TDC) and closed (IVC) immediately after the bottom dead center (BDC) and the EV is opened (EVO) immediately before the bottom dead center (BDC) and closed (EVC) immediately after the top dead center (TDC).

Contrary to this, in the present embodiment, the valve open timing of the EV is shifted toward the top dead center (TDC) as shown in FIG. 27. Namely, by advancing the valve open timing or making it earlier, the hatched area equaling minus work can be generated even during fuel cut as described in connection with FIG. 24 and consequently, engine brake can be generated. By aking the valve open timing of the EV 504*b* earlier than the position indicated by EVO in FIG. 27, the hatched area in FIG. 24 can be increased and engine brake can be strengthened but by making it later than the EVO position, the hatched area in FIG. 25 can be increased to weaken engine brake. This means that the variable range of the EV 504*b* can be increased to widen the dynamic range of engine brake torque.

Figure 28:
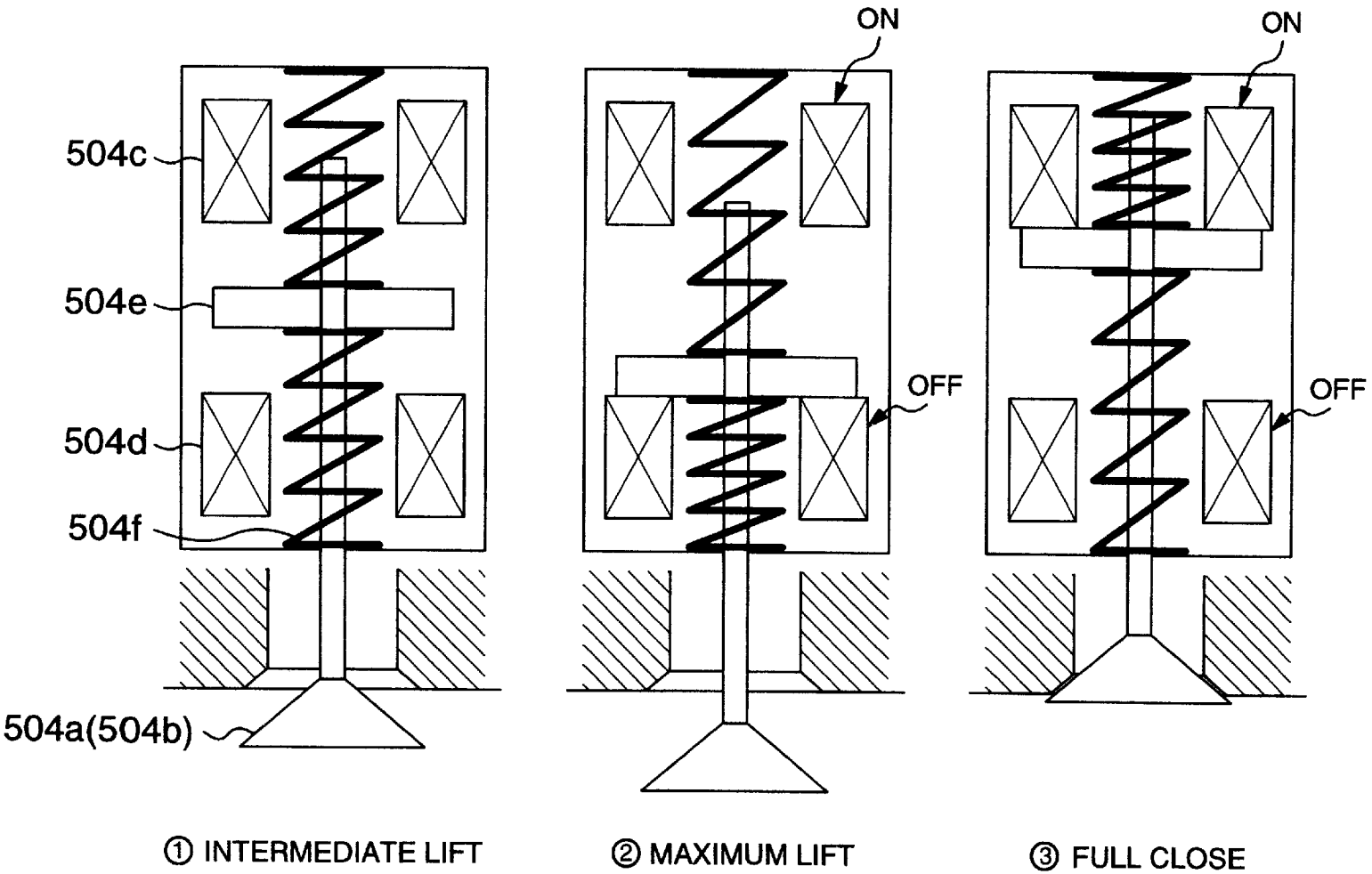
FIG. 28 is a diagram showing the internal construction and operation of the electromagnetically driven intake and exhaust valves in FIG. 1.

Turning now to FIG. 28, there is illustrated an example of concrete structure of each of the IV 504*a* and EV 504*b* in FIG. 1. The valve includes an electromagnetic coil 504*c* to be turned on during valve close, an electromagnetic coil 504*d* to be turned on during valve open and a movable contact 504*e* biased by coil springs 504*f* and operatively attracted to the electromagnetic coil 504*c* or the electromagnetic coil 504*d*.

Then, during engine stop, neither the electromagnetic coil 504*c* nor the electromagnetic coil 504*d* is energized and consequently, the valve is placed in intermediate lift condition at ①. During valve open, the electromagnetic coil 504*d* is energized to place the valve in maximum lift condition at ② and during valve close, the electromagnetic coil 504*c* is energized to place the valve in full close condition at ③.

Figure 29:
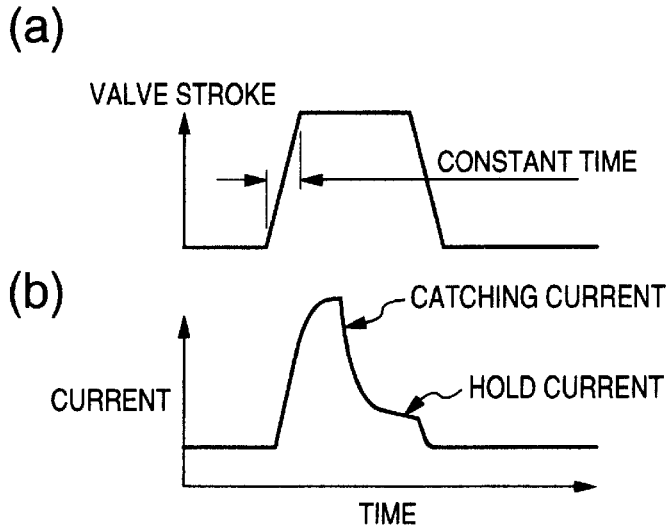
FIG. 29 is a diagram showing an example of supply of drive current to the electromagnetically driven intake and exhaust valves of FIG. 28.

FIG. 29 illustrate at (a) a valve stroke of each of the IV 504*a* and EV 504*b* and illustrates at (b) an example of the manner of applying exciting current to each of the electromagnetic coil 504*c* and electromagnetic coil 504*d*, demonstrating that a driving method is employed in which catching current upon rise of valve close or valve open is raised rapidly and hold current is lowered.

Next, operation of the above-described in-cylinder injection engine control apparatus according to the present embodiment will be described.

Figure 30:
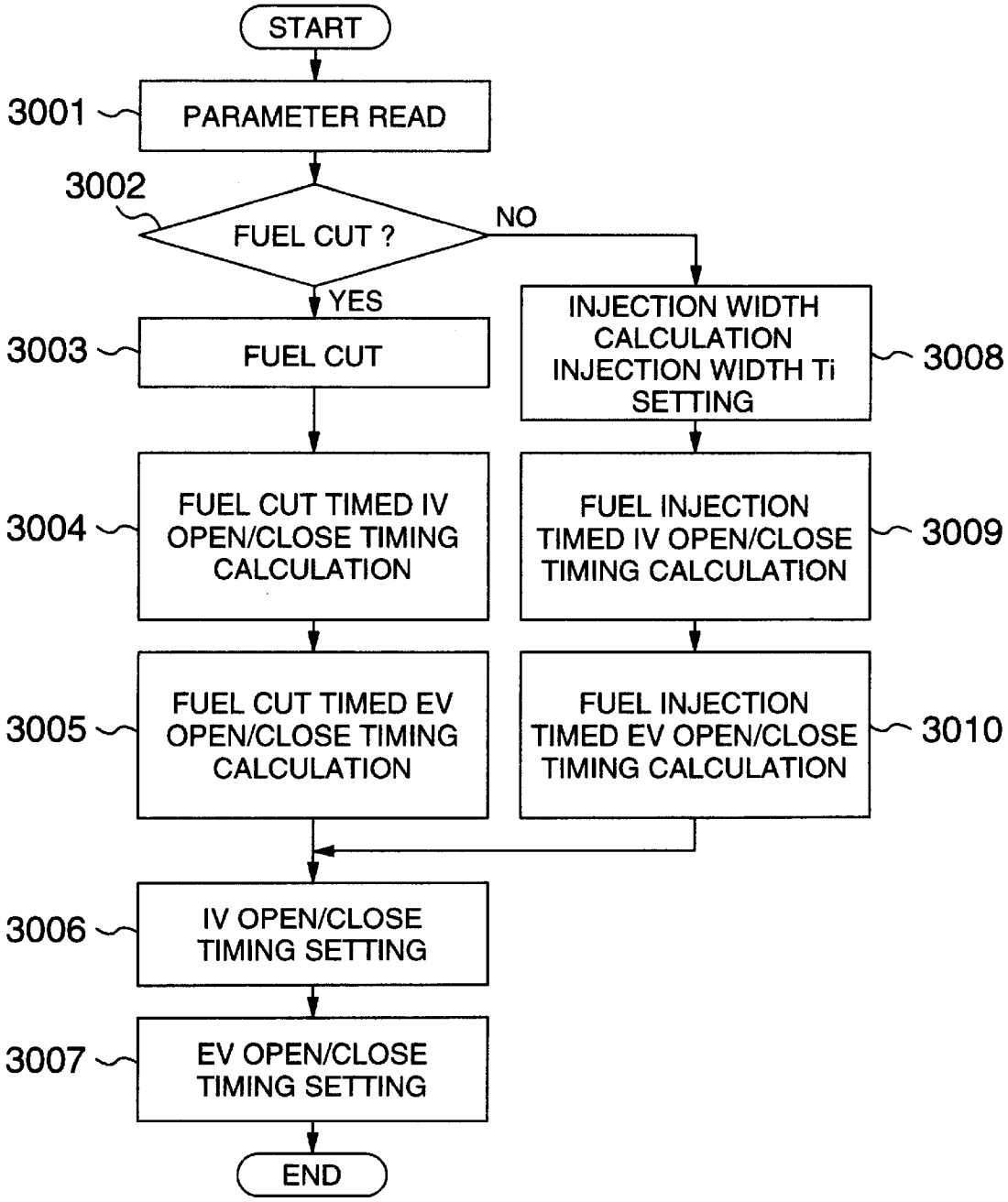
FIG. 30 is a flow chart showing operation of the FIG. 1 engine control apparatus.
Figure 31:
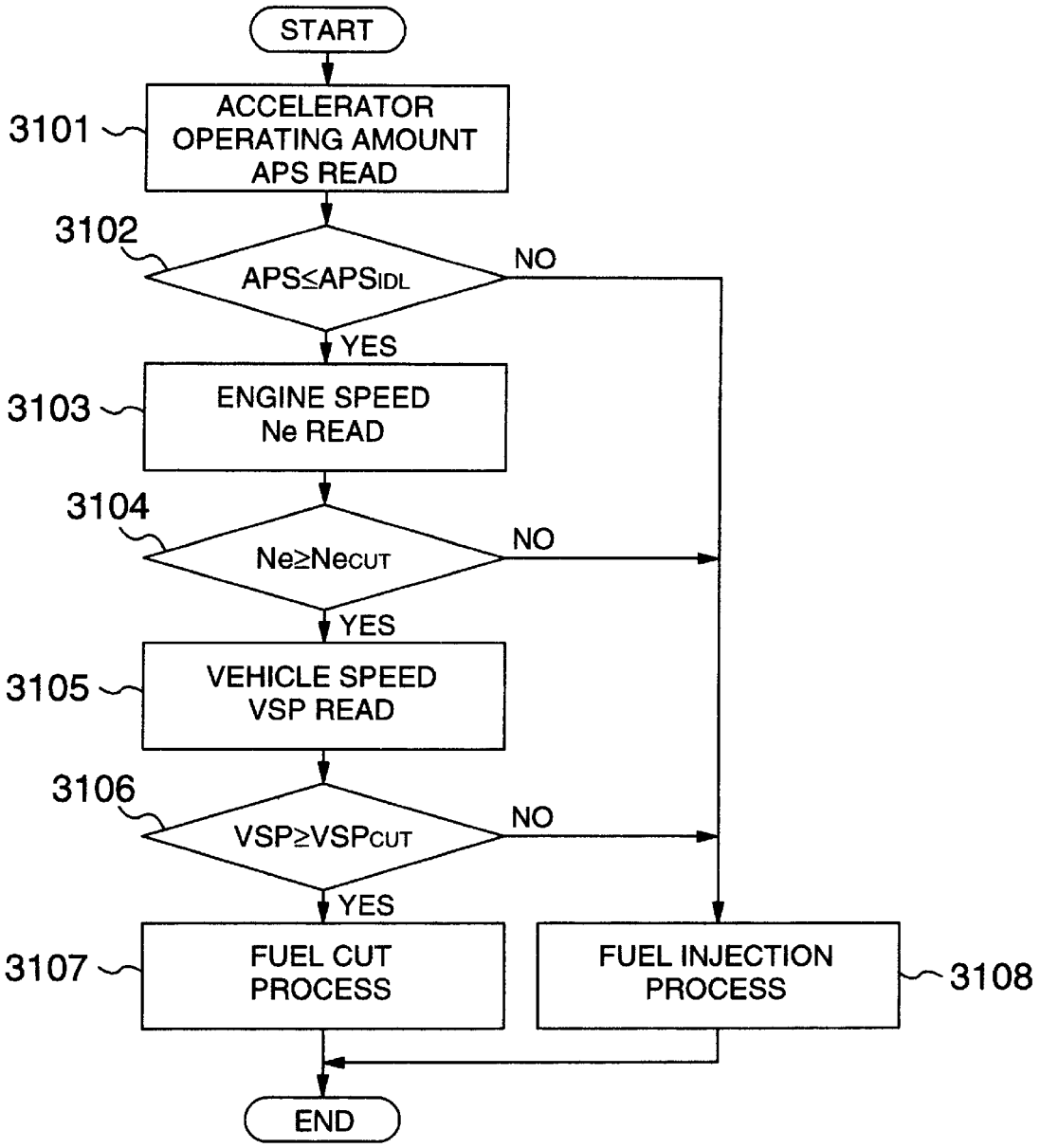
FIG. 31 is a flow chart showing details of parameter read operation in FIG. 30.

Referring to FIG. 30 showing a basic flow chart of the control apparatus, parameters are first read in step 3001. In this parameter reading, accelerator operating amount APS, engine speed Ne and vehicle speed VSP are read in steps 3101, 3103 and 3105, respectively, included in a flow of FIG. 31. After these parameters have been read, it is decided in step 3002 whether fuel cut prevails. The fuel cut is determined by deciding as to whether the accelerator operating amount APS is below the amount during idling, as to whether the engine speed Ne exceeds a predetermined engine speed Necut and as to whether the vehicle speed VSP exceeds a predetermined speed VSPcut in steps 3102, 3104 and 3106, respectively, included in the flow of FIG. 31.

In short, permission of fuel cut is limited by the conditions that the accelerator operating amount is narrower than the predetermined opening, the engine speed is above the predetermined engine speed and the vehicle speed is above the predetermined speed, and as far as these conditions are satisfied, the program proceeds to the fuel cut process in step 3107. This step involves steps 3003 to 3005 in FIG. 30 which will be detailed later. If at least one of the above conditions is unsatisfied, the fuel injection process is carried out in step 3108. This step involves steps 3008 to 3010 in FIG. 30 which will be detailed later.

When the fuel cut is determined in the step 3002, the process for fuel cut is carried out in the step 3003. In the process for fuel cut, the open/close timing of the IV 504*a* is calculated in the step 3004 and the open/close timing of the EV 504*b* is calculated in the step 3005.

Figure 32:
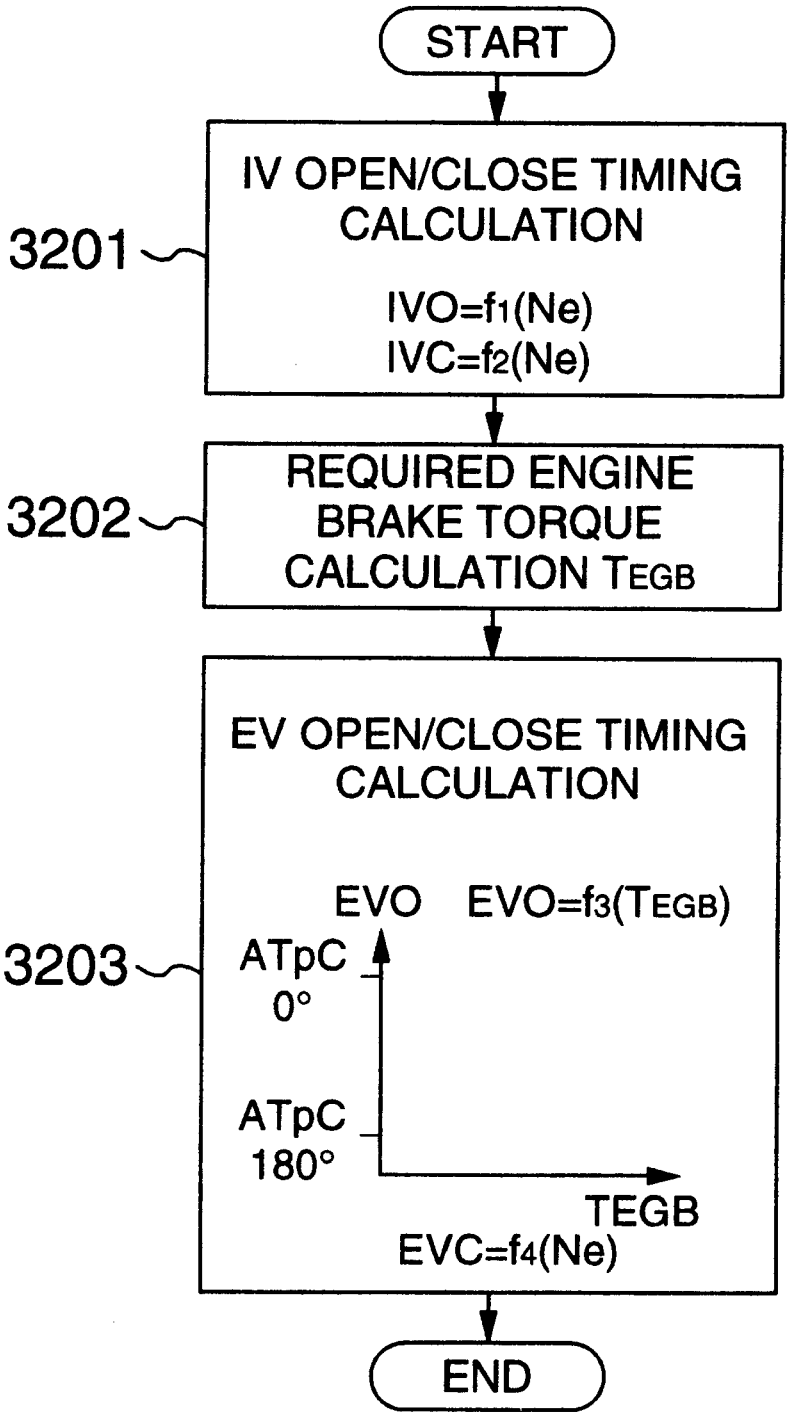
FIG. 32 is a flow chart showing details of calculation of open/close timings of the intake and exhaust valves during fuel cut in FIG. 30.

The calculation of the open/close timing of the IV 504*a* in the step 3004 follows a flow of FIG. 32. Firstly, the timing for valve open (IVO) and the timing for valve close (IVC) of the IV 504*a* are determined through calculation in step 3201. Subsequently, required engine brake torque is determined through calculation in step 3202. In connection with the required engine brake torque, a request for either strong engine brake or weak engine brake is determined.

Figure 34:
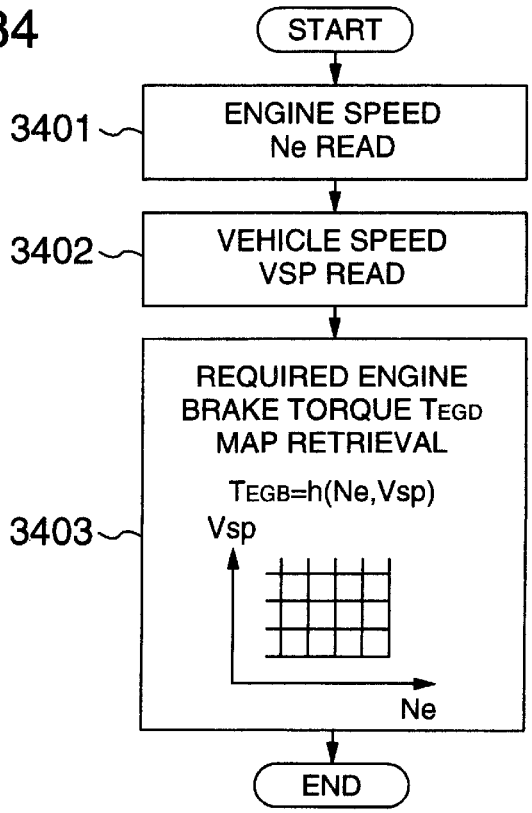
FIG. 34 is a flow chart showing a specific example of calculation of required engine brake torque in FIG. 32.

Operation in the step 3202 is determined pursuant to a flow of FIG. 34. Firstly, engine speed Ne and vehicle speed Vsp are read in steps 3401 and 3402 and required engine brake torque is determined through a map of engine speed Ne and vehicle speed Vsp in step 3403. Then, the valve open/close timing is determined through operation in such a manner that the EV 504*b* is shifted toward ATDC 0° shown in step 3203 in case strong engine brake is requested but is shifted toward ATDC 180° in case weak engine brake is requested.

When valve open/close timings are determined as described above, the open/close timings of the IV 504*a* and the EV 504*b* are set in steps 3006 and 3007, respectively.

On the other hand, when the fuel cut is not determined in the step 3002, fuel injection width Ti is determined through operation and the thus determined fuel injection width Ti is set in the step 3008.

Subsequently, the open/close timings of the IV 504*a* and EV 504*b* are calculated in the steps 3009 and 3010, respectively.

Figure 33:
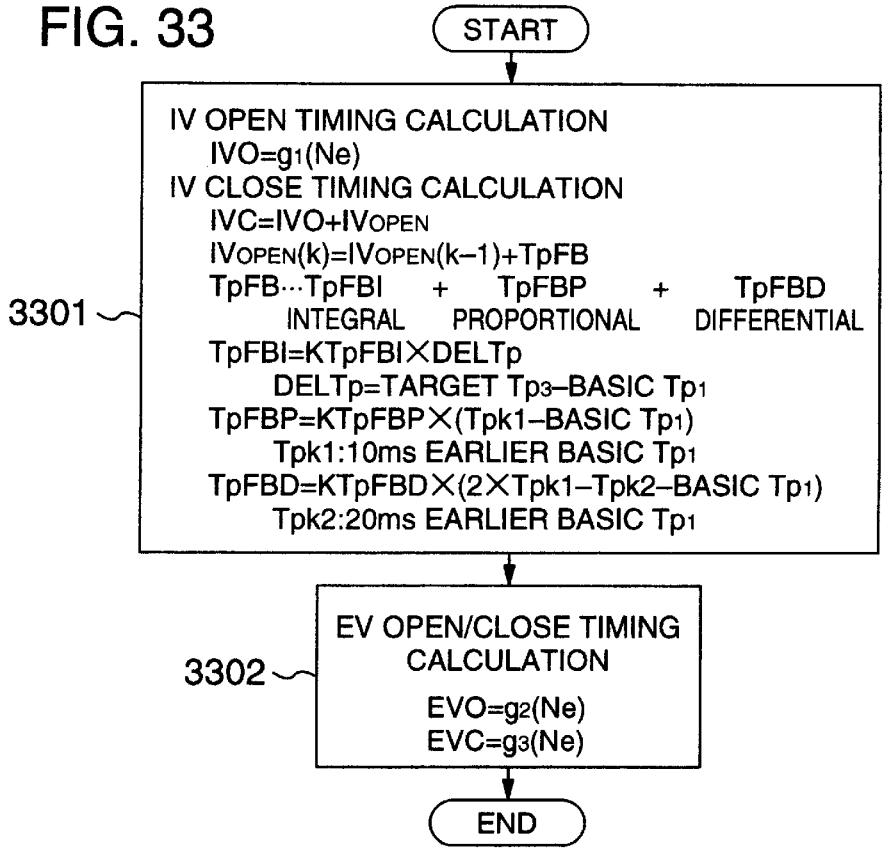
FIG. 33 is a flow chart showing details of calculation of open/close timings of the intake and exhaust valves during fuel injection in FIG. 30.

The operations in the steps 3009 and 3010 are executed pursuant to a flow of FIG. 33. The FIG. 33 flow substitutes for the block diagram of FIG. 19 in terms of arithmetic expressions. Firstly, the valve open timing of the IV 504*a* is calculated in step 3301. As indicated by IVO=g1(Ne), this valve open timing is definitely determined by the engine speed. Here, the valve close timing is of importance, which is calculated pursuant to IVC=IVO+IVopen. Namely, the valve close timing IVC is determined by adding the valve open time to the valve open timing IVO. Here, IVopen is determined pursuant to IVopen(k)=IVopen(k−1)+TpFB, where TpFB is determined pursuant to TpFB=TpFBI+TpFBP+TpFBD. The TpFBI, TpFBP and TpFBD have values obtained from the integral/proportional/differential process and TpFBI is determined pursuant to TpFBI=kTpFBI×DELTp, where DELTp=target fuel injection quantity $Tp_3$−basic fuel injection quantity $Tp_1$.

The TpFBP is determined pursuant to TpFBP=kTpFBP×(Tpk1−basic injection quantity $Tp_1$), where Tpk1 is a 10 ms earlier value of the basic fuel injection quantity $Tp_1$. Further, TpFBD is determined pursuant to TpFBD=kTpFBD×(2×Tpk1−Tpk2−basic fuel injection quantity $Tp_1$), where Tpk2 is a 20 ms earlier value of the basic fuel injection quantity $Tp_1$.

Next, the open/close timings of the EV 504*b* are calculated in step 3302. As indicated by EVO=g2(Ne) and EVC=g3(Ne), the open/close timings are definitely determined by the engine speed. The ensuing procedure is similar to that in the steps 3202 and 3203 of the FIG. 32 flow and will not be described.

When the calculation of the open/close timings of the IV 504*a* and EV 504*b* is completed in case the fuel cut is determined or is not determined in the step 3002 of FIG. 30, the open/close timings of the IV 504*a* and EV 504*b* are set in the steps 3006 and 3007.

Through the valve open/close control based on the flow as described above, the valve open timing of the EV 504*b* can start from the first half of the expansion stroke, with the result that minus work during the compression to expansion stroke can be obtained as explained in connection with FIGS. 24 and 25 and engine brake torque can be obtained even during the fuel cut. Further, by making the valve open timing of the EV 504*b* variable as explained with reference to FIG. 27, engine brake torque can be controlled.

Next, another embodiment of the in-cylinder injection engine control apparatus according to the present invention will be described. In this embodiment, the in-cylinder injection engine control apparatus of the previous embodiment of the invention is equipped in an automobile or the like vehicle and constructed in combination with a control apparatus of equipment of the automobile. The control apparatus of the present embodiment is outlined in a control block diagram of FIG. 35.

Figure 35:
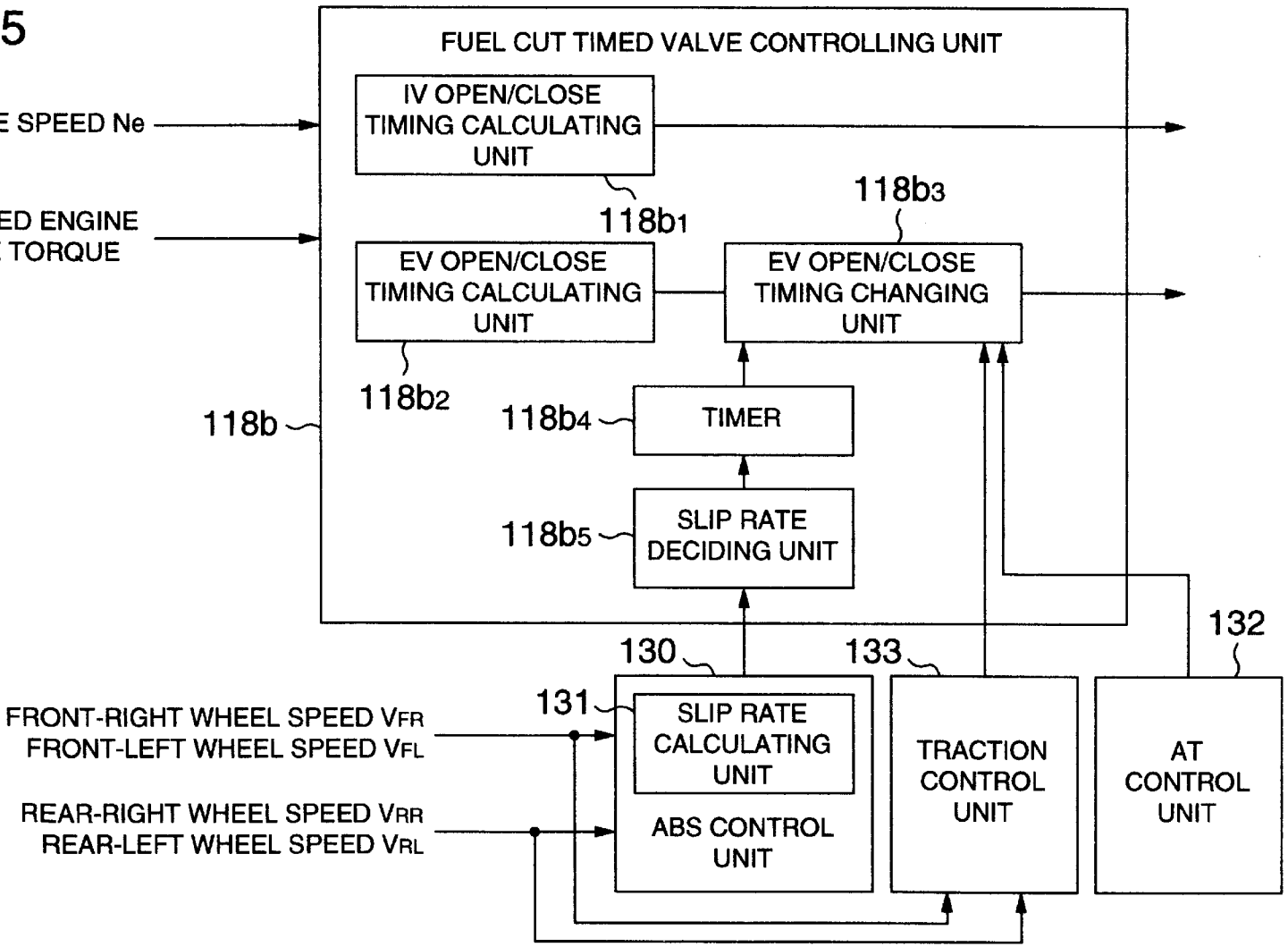
FIG. 35 is a partial control block diagram showing a combination of the FIG. 4 control block diagram of the engine control apparatus with ABS control, AT control and traction control.

In the control block diagram of FIG. 35, the fuel cut timed valve controlling unit 118*b* in the FIG. 4 control block diagram showing the previous embodiment is illustrated in greater detail. Thus, the fuel cut timed valve controlling unit 118*b* includes IV open/close timing calculating unit 118$b_1$, EV open/close timing calculating unit 118$b_2$ and EV open/close timing changing unit 118$b_3$ for changing the open/close timing of the EV calculated by the exhaust valve open/close timing calculating unit 118$b_2$.

The EV open/close timing changing unit 118$b_3$ changes the open/close timing of the EV once calculated and set, on the basis of output signals from control unit of the control apparatus such as ABS (anti-lock brake system), traction unit and AT unit, and delivers a changed open/close timing signal.

Figure 36:
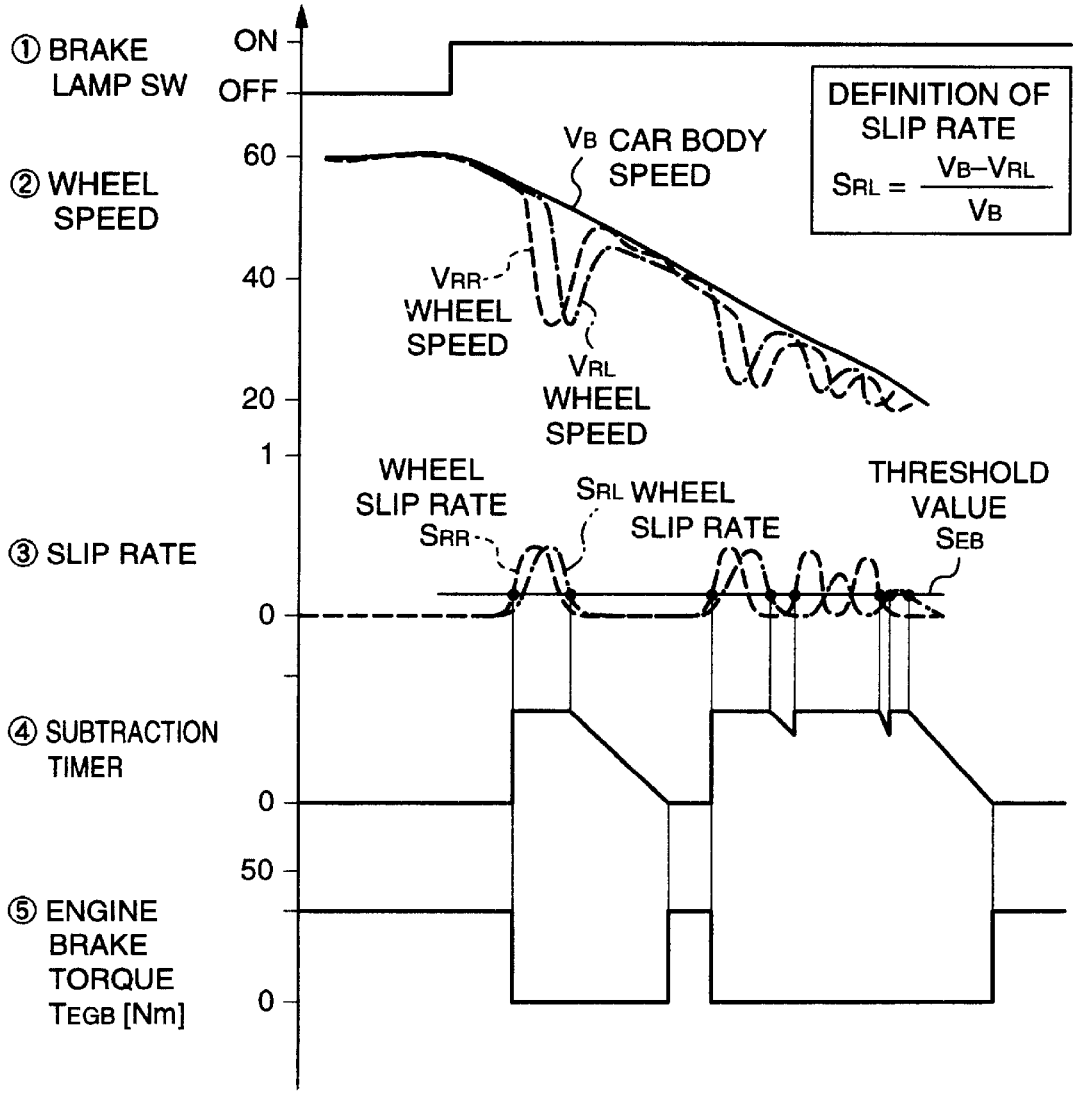
FIG. 36 is a time chart showing an instance where the FIG. 1 engine control apparatus is applied to an ABS.

FIG. 36 shows a time chart in an embodiment in which the fuel cut timed valve controlling unit 118*b* of the FIG. 4 embodiment is used in combination with the ABS.

ABS control unit 130 shown in FIG. 35 has slip rate calculation unit 131 for calculating a slip rate during ABS control and the slip rate calculated by the slip calculating unit 131 is delivered to the fuel cut timed valve controlling unit 118*b*. The fuel cut timed valve controlling unit 118*b* includes slip rate deciding unit 118$b_5$ and timer unit 118$b_4$. The slip rate deciding unit 118$b_5$ decides whether the slip rate is larger than a predetermined threshold value. A signal indicative of decision result is delivered to the EV open/close timing changing unit 118$b_3$ through the timer unit 118$b_4$ having a delay timer.

Control associated with the ABS will be described with reference to the flow chart of FIG. 36. Normally, by detecting actuation of the brake lamp switch (SW), actuation of the ABS is detected as shown at ①. The slip rate is defined by SRL=(VB−VRL)/VB, where SRL (slip rear left) represents slip rate at the rear-left wheel in an FR car, VB represents car body speed and FRL represents speed of the rear-left wheel. When slip rate SRL=1, the wheel is locked to be placed in slip condition and when slip rate SRL=0, the car body speed equals the wheel speed.

When the ABS is actuated, brake is intermittently applied to rear-right wheel VRR and rear-left wheel VRL in accordance with deceleration of the car body speed VB as indicated at ②. The actuation of the ABS fulfils itself when sliding friction against the road surface is small owing to, for example, freezing but when engine brake due to the aforementioned valve open/close control is applied excessively, the effect of the ABS cannot sometimes be obtained.

Accordingly, threshold value SEB corresponding to a desired slip rate SRL is set as indicated at ③ and a subtraction timer is actuated which performs operation indicated at ④ at the time that the slip rate SRL of the rear-right wheel VRR or the rear-left wheel VRL crosses the threshold value SEB from below to above to prevent engine brake torque from being applied during actuation of the subtraction timer as indicated at ⑤.

The subtraction timer starts to subtract the count gradually at the time that the slip rate SRL of each of the rear-right wheel VRR and rear-left wheel VRL to prevent the engine brake torque from being applied only during for a predetermined time (for example, 2S) and allows the engine brake torque to be applied when the count becomes zero. The timer has the function of permitting re-triggering in which in case the slip rate SRL of the rear-right wheel VRR or rear-left wheel VRL crosses the threshold value SEB within the predetermined time 2S during actuation of the subtraction timer, the subtraction timer begins to repeat the count subtraction at that time.

In this manner, the engine brake torque can be prevented from being applied when the slip rate is high to sufficiently derive the effect of the ABS. In other words, under conditions that the road surface condition is good and the slip rate is low to allow the engine brake torque to be applied, sufficient braking force can be obtained regardless of the actuation/non-actuation of the ABS.

Figure 37:
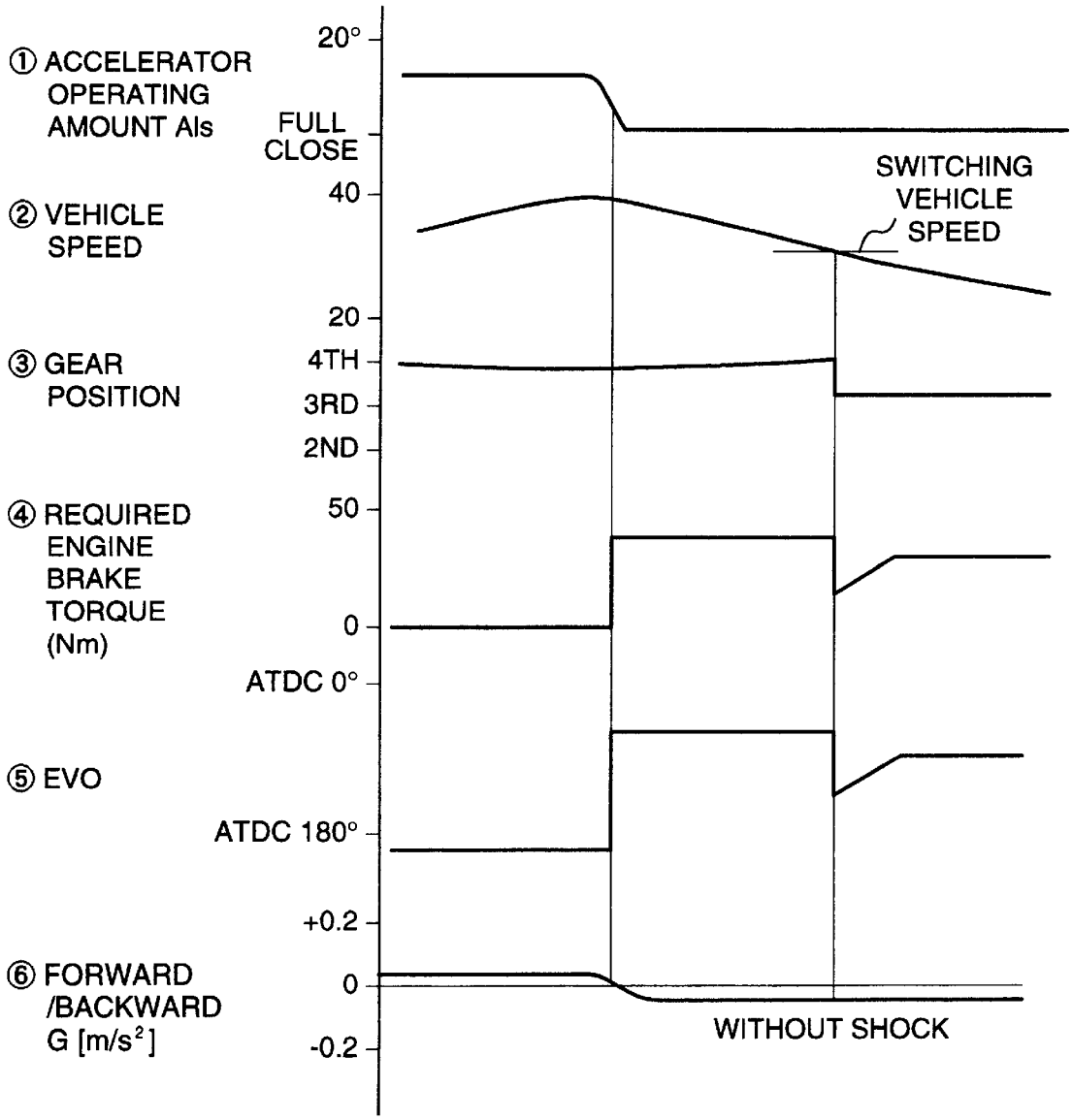

Referring to FIG. 37, there is illustrated a time chart in another embodiment in which the fuel cut timed valve controlling unit 118*b* of the FIG. 4 embodiment is used in combination with the AT unit of automobile.

AT control unit 132 of the AT (Automatic Transmission) unit shown in FIG. 35 detects down shifting to the low speed side gear and delivers a detection signal to the EV open/close timing changing unit $\mathbf{118}b_3$ of the fuel cut timed valve controlling unit 118*b* to change the open/close timing of the EV.

Figure 38:
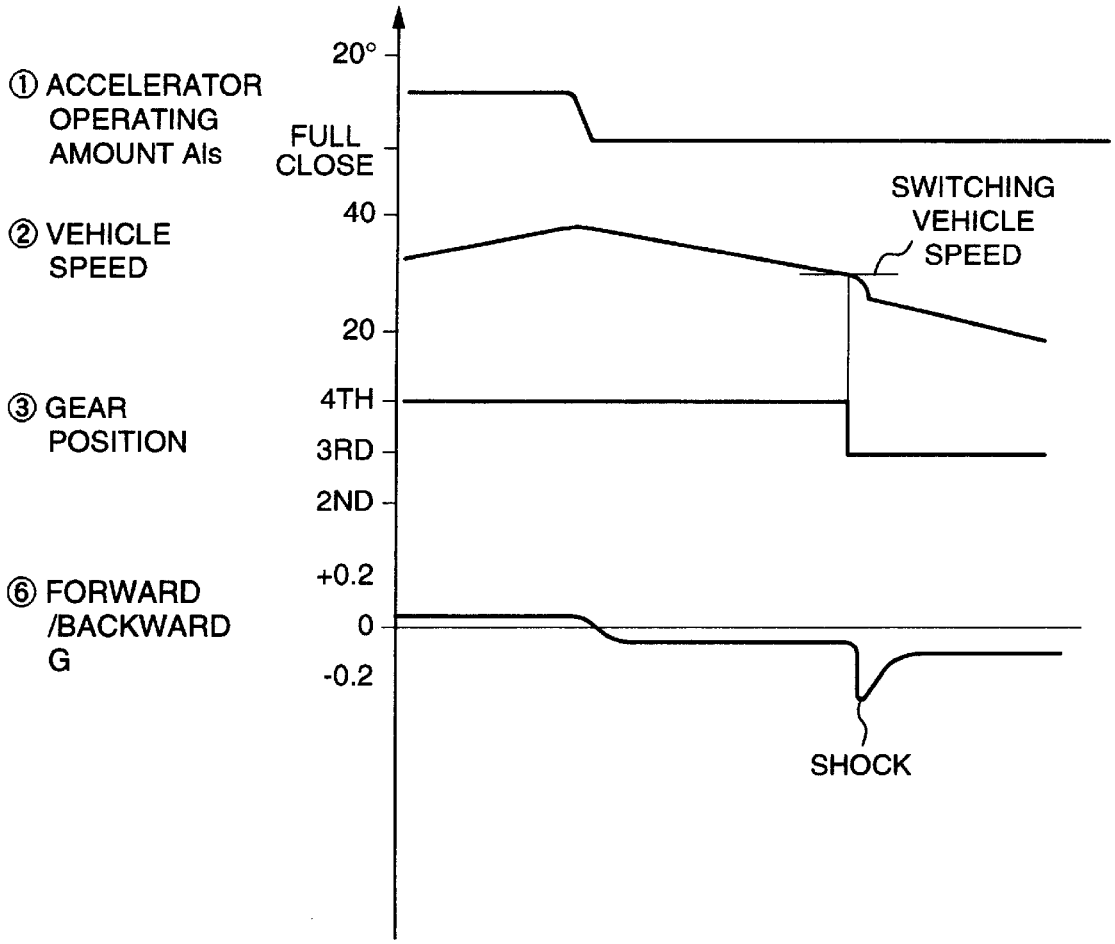
FIG. 38 is a time chart showing AT control in an engine.

In the general AT unit, the accelerator pedal is not operated as indicated at ① and ② in a time chart of FIG. 38 and as the vehicle speed decreases, down shifting is automatically effected from the gear position for fourth speed to the gear position for third speed as indicated at ③ through the use of a map indicating the relation between the accelerator operating amount and the vehicle speed. At the time when the driver release his foot from the accelerator pedal, G ($m/s^2$) along the direction of forward/backword indicative of forward/backward acceleration of the vehicle slightly decreases to the minus side as indicated at ④. This minus G, caused by the action of weak engine brake, is not so shocking. In contrast, with down shifting automatically effected from the fourth speed to the third speed as indicated at ③, stronger engine brake than that applied when the accelerator is closed acts and an intense shock is sometimes given during down shifting as indicated at ④.

Accordingly, in the embodiment of FIG. 37, when the accelerator is closed as indicated at ①, required engine brake torque is generated as indicated at ④. This required engine brake torque is obtained from the map of the vehicle speed and engine speed explained in connection with the step 3403 in FIG. 34. The required engine torque is slightly decreased as indicated at ④ when the vehicle speed decreases as indicated at ② and automatic down shifting to the gear position for third speed is effected as indicated at ③ and thereafter is increased at a desired inclination angle.

When the accelerator is closed in accordance with the required engine brake torque as indicated at ⑤, the valve open timing of the EV 504*b* is shifted toward ATDC 0° and as soon as down shifting to the gear position for third speed is effected as indicated at ③, the valve open timing of the EV 504*b* is shifted toward ATDC 180E in accordance with the required engine brake torque indicated at ④. Thereafter, the valve open timing is shifted toward ATDC 0° at a desired inclination angle. The valve open timing of the EV 504*b* can be obtained from the map explained in connection with the step 3203 in FIG. 32.

In this manner, by changing the valve open timing of the EV 504*b* in accordance with down shifting of the gear position, the engine brake responsible for causing a shock to be generated during down shifting can be weakened and as a result, automatic speed change control free from shock can be ensured.

The above-described valve open/close control can be applied to not only AT control but also traction control. Namely, when number of N (N is an integer.) cylinders are inactivated for in traction control by the traction control unit 133 shown in FIG. 35, the valve open timing of the EV of the cylinder in which fuel cut proceeds is changed to change minus torque continuously, so that discontinuity of torque can be prevented between the N cylinders cut timing and the number of (N+1) cylinders cut timing and smooth traction control can be effected.

Some embodiments of the engine control apparatus with electromagnetically driven IV and EV according to the invention have been described so far but the present invention is in no way limited to the foregoing embodiments and can be changed and altered in design in various ways without departing from the gist of the present invention recited in the appended claims.

An engine torque control system partly relative to the present invention is disclosed in JP-A-10-18891 (FIGS. 3 and 4). An idling speed control system partly relative to the present invention is disclosed in JP-A-10-212989 (FIGS. 6 and 7).

As will be seen from the foregoing description, in the engine control apparatus with electromagnetically driven IV and EV according to the present invention, the valve open timing of the EMV during fuel cut is made to be variable between the initial stage of expansion stroke (near TDC) and the last stage thereof (near BDC) and consequently, the magnitude of engine brake torque can be controlled and the dynamic range of the engine brake torque can be widened.

Further, the engine control apparatus with electromagnetically driven IV and EV according to the invention can be used in combination with ABS control, traction control and AT control in an automobile when the engine is equipped in the automobile to ensure smooth running of the automobile.

What is claimed is:

1. An engine control apparatus with electromagnetically driven intake and exhaust valves, comprising:

valve control means including fuel injection timed valve controlling means, fuel cut timed valve controlling means and means for controlling drive of the intake and exhaust valves on the basis of output signals of said two means, wherein said fuel cut timed valve controlling means includes exhaust valve open/close timing calculating means for making the valve open timing of the exhaust valve earlier than the fuel injection timing during fuel cut.

2. An engine control apparatus with electromagnetically driven intake and exhaust valves according to claim 1, wherein said valve control means includes:

fuel cut deciding means for determining fuel cut under at least one condition that the accelerator operating amount is detected as being near zero; and valve drive changing means for switching an output signal from said fuel injection timed valve controlling means to an output signal of said fuel cut timed valve controlling means when the fuel cut is determined.

3. An engine control apparatus with electromagnetically driven intake and exhaust valves according to claim 2, wherein said fuel cut timed valve controlling means controls the valve open timing of said exhaust valve to make it variable between an initial stage of expansion stroke and a late stage thereof during the fuel cut operation.

4. An engine control apparatus with electromagnetically driven intake and exhaust valves according to claim 1, wherein said fuel cut timed valve controlling means controls the valve open timing of said exhaust valve to make it variable between an initial stage of expansion stroke and a late stage thereof during the fuel cut operation.

5. An engine control apparatus with electromagnetically driven intake and exhaust valves according to claim 4, wherein when large braking torque is required, said fuel cut timed valve controlling means controls the valve open timing of said exhaust valve such that it approaches the initial stage of expansion stroke and when small braking torque is required, said fuel cut timed valve controlling means controls the valve open timing of said exhaust valve such that it approaches the late stage of expansion stroke.

6. An engine control apparatus with electromagnetically drive intake and exhaust valves according to claim 4, wherein during engine braking, said fuel cut timed valve controlling means controls the valve open timing of said exhaust valve such that it gradually advances from the late stage of expansion stroke to the initial stage thereof.

7. An engine control apparatus with electromagnetically driven intake and exhaust valves according to claim 1, wherein said fuel cut timed valve controlling means includes exhaust valve open/close timing changing means for changing the open/close timing of said exhaust valve calculated by said exhaust valve open/close timing calculating means.

8. An engine control apparatus with electromagnetically driven intake and exhaust valves according to claim 7, wherein said exhaust valve open/close timing changing means changes stepwise the valve open timing of said exhaust valve from the initial or middle stage of expansion stroke to the late stage thereof as soon as down shifting to the low speed side gear is detected during automatic transmission control by means of automatic transmission control means and thereafter changes gradually the valve open timing of said exhaust valve from the late stage of expansion stroke to the middle or initial stage thereof.

9. An engine control apparatus with electromagnetically driven intake and exhaust valves according to claim 7, wherein when said exhaust valve open/close timing changing means receives a request for inactivating certain number of cylinders from traction control means, it changes the valve open timing of said exhaust valve corresponding to the cylinder in which fuel cut proceeds during the certain number of cylinders cut to thereby change minus torque continuously.

10. An engine control apparatus with electromagnetically driven intake and exhaust valves according to claim 7, wherein said fuel cut timed valve controlling means includes slip rate deciding means and timer means, and said slip rate deciding means decides a slip rate by slip rate calculating means of ABS control means when ABS control by said ABS control means proceeds and delivers a decision result to said exhaust valve open/close timing changing means through said timer means.

11. An engine control apparatus with electromagnetically driven intake and exhaust valves according to claim 10, wherein when said slip rate exceeds a predetermined threshold value, said timer means turns on the output to said exhaust valve open/close timing changing means for a predetermined time so as to cause said exhaust valve open/close timing changing means to retard the valve open timing of said exhaust valve toward the late stage of expansion stroke while a request for decreasing engine brake torque is made.

12. An engine control apparatus with electromagnetically driven intake and exhaust valves according to claim 10, wherein when the decision result by said slip rate deciding means is below the threshold value and a request for increasing engine brake torque is made, said exhaust valve open/close timing changing means advances the valve open timing of said exhaust valve toward the initial stage of expansion stroke.

13. A control apparatus for an engine with electromagnetically driven intake and exhaust valves, comprising:

accelerator detecting means for detecting an accelerator operating amount Acc;

air flow meter means for measuring intake air flow Qa sucked into cylinders of said engine;

engine speed measuring means for measuring an engine speed Ne;

basic fuel injection quantity deciding means for determining basic fuel injection quantity $Tp_1$ as a basic fuel injection width per cylinder by dividing said intake air flow Qa by said engine speed Ne and multiplying the product by a coefficient which makes the air-fuel ratio a stoichiometric air-fuel ratio;

reference fuel injection deciding means for determining target reference fuel injection quantity $Tp_2$ which is on the same dimension as said basic fuel injection width and which is a criterion for target fuel injection quantity $Tp_3$, from two variables of the accelerator operating amount Acc and engine speed Ne;

target fuel injection calculating means for determining the target fuel injection quantity $Tp_3$ by multiplying said reference fuel injection quantity $Tp_2$ by a target air-fuel ratio and dividing the product by the stoichiometric air-fuel ratio;

fuel injection width calculating means for calculating a fuel injection width Ti by adding to said reference fuel injection quantity $Tp_2$ an invalid injection width Ts indicative of a delay relative to an injector signal; and valve control means including:

fuel injection timed valve controlling means for controlling valve open operation of said intake valve by retrieving maps of control parameters for selection of optimum control parameters, comprising optimum ignition timing, air-fuel ratio, fuel injection timing and EGR rate, on axes representing engine speed and engine load in accordance with a running state of said engine, feedback-controlling said intake air flow Qa to cause said basic fuel injection quantity $Tp_1$ to follow said target fuel injection quantity $Tp_3$ and determining the valve open timing of said intake valve as an intermediate parameter in the feedback of said intake air flow Qa;

fuel cut timed valve controlling means; and intake and exhaust valve drive controlling means.

14. An engine control apparatus with electromagnetically driven intake and exhaust valves according to claim 13, wherein said reference fuel injection quantity $Tp_2$ is a variable retrieved through a map of engine speed axis and accelerator operating amount axis.

15. An engine control apparatus with electromagnetically driven intake and exhaust valves according to claim 13, wherein said reference fuel injection quantity $Tp_2$ is a variable retrieved through a table of accelerator operating amount axis.

16. An engine control apparatus with electromagnetically driven intake and exhaust valves according to claim 13, wherein said control parameter includes one of air-fuel ratio, ignition timing, fuel injection start timing, fuel injection end timing, EGR ratio and magnitude of in-cylinder swirl or a combination of two or more said parameters.

17. An engine control apparatus with electromagnetically driven intake and exhaust valves according to claim 16, wherein said control parameters are maps retrieved on axes of the engine speed and said reference fuel injection quantity $Tp_2$ and each of the maps has three sheets of maps for stoichiometry, homogeneous lean and stratified lean.

18. An engine control apparatus with electromagnetically driven intake and exhaust valves according to claim 13 further comprising idle engine speed control means for increasing said reference fuel injection quantity $Tp_2$ when an actual engine speed is smaller than a target engine speed and conversely, decreasing said reference fuel injection quantity $Tp_2$ when said actual engine speed is larger than said target engine speed.

19. An engine control apparatus with electromagnetically driven intake and exhaust valves according to claim 18, wherein said idle engine speed control means detects setting-on of a load by a load switch to increase said reference fuel injection quantity $Tp_2$ by a predetermined amount.

20. An engine control apparatus with electromagnetically driven intake and exhaust valves according to claim 19, wherein said load switch is any one of air conditioner switch, power steering switch, electrical load switch and electric radiator fan switch or a combination of a plurality of them.

21. An engine control apparatus with electromagnetically driven intake and exhaust valves according to claim 19, wherein when said load switch is set on, an idle engine speed control means increases said reference fuel injection quantity $Tp_2$ by a predetermined amount and at the same time increases the target engine speed by a predetermined amount.

* * * * *